United States Patent [19]

Goto et al.

[11] Patent Number: 4,697,708

[45] Date of Patent: Oct. 6, 1987

[54] AUTOMATIC BANK NOTE DEPOSITING AND DISPENSING MACHINE

[75] Inventors: Masao Goto; Haruo Kimura; Toshihiko Okada; Katsunori Yuasa; Tetuzo Ito, all of Tokyo, Japan

[73] Assignee: Oki Electric Industry Co., Ltd., Tokyo, Japan

[21] Appl. No.: 743,967

[22] Filed: Jun. 12, 1985

[30] Foreign Application Priority Data

Jun. 12, 1984 [JP] Japan ..... 59-119114
Jun. 12, 1984 [JP] Japan ..... 59-119115

[51] Int. Cl.[4] ..... B07C 5/34

[52] U.S. Cl. ..... 209/534; 186/37; 235/379

[58] Field of Search ..... 209/534; 235/379; 186/37; 194/206; 221/6, 9–11, 185; 271/3.1, 9

[56] References Cited

U.S. PATENT DOCUMENTS

| | | | |
|---|---|---|---|
| 4,017,004 | 4/1977 | Onoe et al. | 271/9 X |
| 4,023,011 | 5/1977 | Nakajima et al. | 194/207 X |
| 4,365,700 | 12/1982 | Arimoto et al. | 194/206 |
| 4,479,049 | 10/1984 | Hirose | 209/534 X |
| 4,524,268 | 6/1985 | Fukatsu | 209/534 X |
| 4,533,824 | 8/1985 | Watanabe | 235/379 |

FOREIGN PATENT DOCUMENTS

| | | | |
|---|---|---|---|
| 0109743 | 5/1984 | European Pat. Off. | 209/534 |
| 0143663 | 6/1985 | European Pat. Off. | 235/379 |
| 57-75371 | 5/1982 | Japan | 235/379 |

*Primary Examiner*—Johnny D. Cherry
*Assistant Examiner*—Edward M. Wacyra
*Attorney, Agent, or Firm*—Wenderoth, Lind & Ponack

[57] ABSTRACT

An automatic bank note depositing and dispensing machine includes a first detector for detecting when the number of bank notes in a container is smaller than a first prescribed number, a second detector for detecting when the number of bank notes in the container is larger than a second prescribed number, a bank note transfer assembly for delivering bank notes to and receiving bank notes from a fixed or self-propelled external delivery unit in response to output signals from the first and second detectors, a first feeder for receiving bank notes via the bank note transfer assembly from the external delivery unit when the number of bank notes in the container is detected by the first detector as being smaller than the first prescribed number, and for feeding the received bank notes to the bank note container, and a second feeder for feeding bank notes via the bank note transfer assembly from the bank note container to the external delivery unit when the number of bank notes in the container is detected by the second detector as being larger than the second prescribed number.

6 Claims, 42 Drawing Figures

| | |
|---|---|
| Fig. 6A | Fig. 6C |
| Fig. 6B | Fig. 6D |

| | |
|---|---|
| Fig.7A | Fig.7D |
| Fig.7B | Fig.7E |
| Fig.7C | Fig.7F |

| | |
|---|---|
| Fig.11A | Fig.11C |
| Fig.11B | Fig.11D |

AUTOMATIC BANK NOTE DEPOSITING AND DISPENSING MACHINE

BACKGROUND OF THE INVENTION

1. Field of the Invention

The present invention relates to an automatic bank note depositing and dispensing machine for use in a monetary facility such as a bank for depositing and dispensing bank notes or paper currencies.

2. Description of the Related Art

Bank note depositing and dispensing machines recently used at teller's cages in monetary facilities such as banks have a circulatory bank note depositing and dispensing mechanism in order to use funds more efficiently and reduce labor in supplying and collecting bank notes. The circulatory bank note depositing and dispensing mechanism operates by ascertaining whether deposited bank notes are genuine or not, classifying those bank notes which are judged as being genuine into accepted bank notes which are dispensable again and rejected bank notes which are not, and delivering the accepted bank notes in the bank note depositing and dispensing machine for dispensation.

The circulatory bank note depositing and dispensing machine however suffers certain drawbacks. Specifically, if more bank notes are deposited in the machine than bank notes dispensed, then the bank note container will be filled with deposited bank notes. If, on the other hand, more bank notes are dispensed from the machine than bank notes deposited, then the bank note container will run out of bank notes. Therefore, bank notes should manually be loaded into the container or collected from the container. Since the machine involves manual labor in handling bank notes, the bank notes in the machine are required to be closely inspected. For this reason, the circulatory bank note depositing and dispensing machine is not a sufficient labor saver and prevents funds from being available highly efficiently.

U.S. Pat. No. 4,017,004 to Onoe et al. discloses a paper money dispensing apparatus, and U.S. Pat. No. 4,023,011 to Nakajima et al. reveals an automatic bank note depositing machine.

SUMMARY OF THE INVENTION

In view of the problems with the conventional bank note depositing and dispensing machine, it is an object of the present invention to provide an automatic bank note depositing and dispensing machine for use at a teller's cage, which requires no manual laber in supplying and collecting bank notes, so that the machine is a labor saver and allows funds to be available highly efficiently.

According to the present invention, the automatic bank note depositing and dispensing machine is capable of automatically collecting bank notes from a bank note container and sending them to an external delivery unit or a self-propelled vehicle with an external bank note depositing and dispensing device when a greater number of bank notes than a prescribed number are contained in the container, and of automatically supplying bank notes into the container from the external delivery unit or the self-propelled vehicle with the external bank note depositing and dispensing device when a smaller number of bank notes than the prescribed number are contained in the container. The automatic bank note depositing and dispensing machine includes a means for supplying bank notes from the external delivery unit or the selfpropelled vehicle when the detected number of bank notes contained in the bank note container is too small, a means for collecting bank notes from the container and deliverying them to the external delivery unit or the self-propelled vehicle when the detected number of bank notes contained in the container is too large, a delivery means for supplying the bank notes, and a collecting means for collecting the bank notes.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
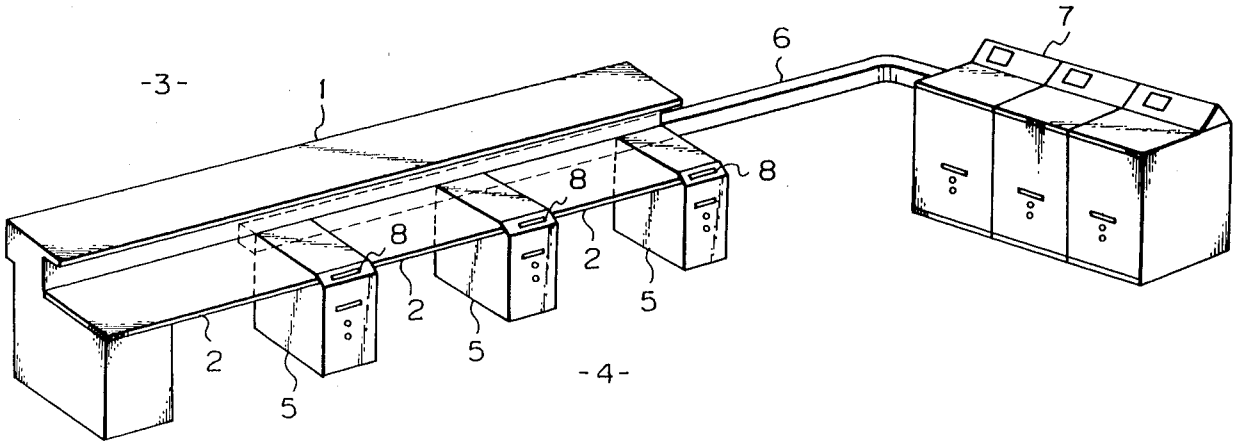
FIG. 1 is a perspective view of a system comprising bank note depositing and dispensing machines at teller's cages, a delivery device, and external accounting units.

Like or corresponding parts are denoted by like or corresponding reference characters throughout several views.

An embodiment of the present invention will be described with reference to FIGS. 1 through 8.

FIG. 1 illustrates a system of bank note depositing and dispensing machines 5 at teller's cages, an external delivery unit 6, and external accounting units 7. Denoted at 1 is a counter in front of teller's cages or windows, 2 teller's tables, 3 a customer floor, and 4 a teller floor. The bank note depositing and dispensing machines 5 are positioned at one side of the teller's tables 2. The external accounting units 7 are installed on the floor 4 in a spaced relationship to the bank note depositing and dispensing machines 5. The external delivery unit 6 is connected between the bank note depositing and dispensing machines 5 and the external accounting units 7 and positioned at the rear ends of the bank note depositing and dispensing machines 5 through the counter 1 for delivering and receiving bank notes. Tellers insert bank notes into and receive bank notes from slots 8 in the respective bank note depositing and dispensing machines 5.

Figure 2:
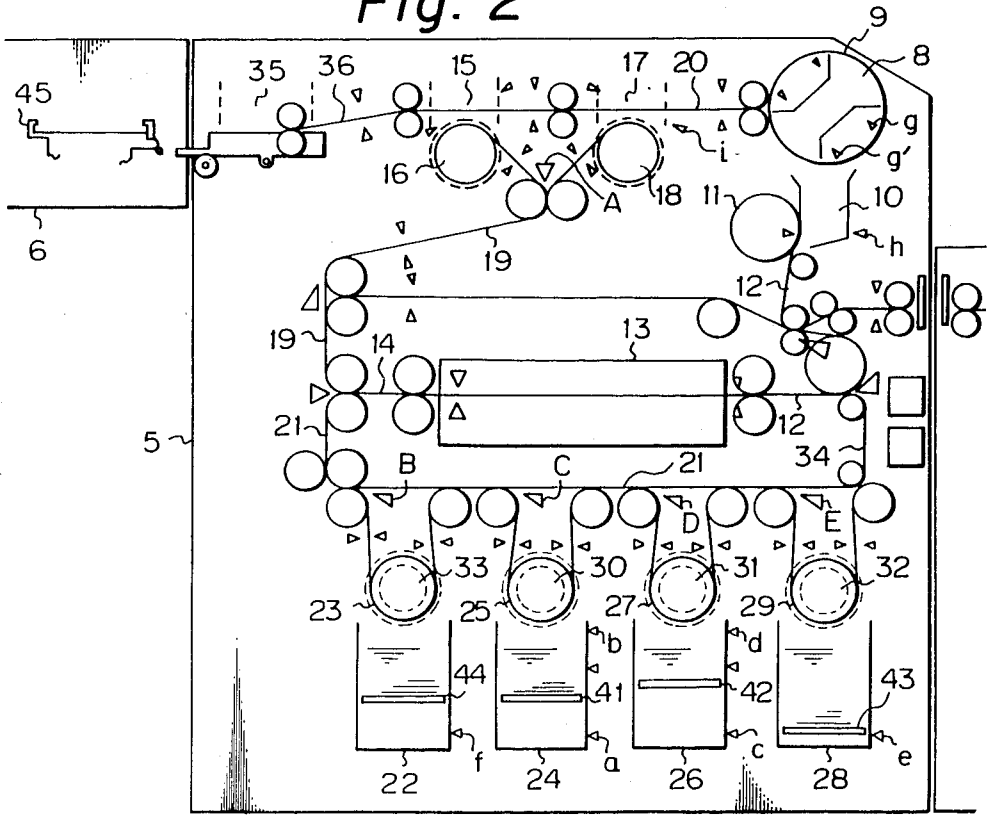
FIGS. 2 through 5 are schematic side elevational views of an internal mechanism of each of the bank note depositing and dispensing machines.

As shown in FIG. 2, each of the bank note depositing and dispensing machines 5 has a slot 8 through which deposited bank notes are charged into the machine 5 and bank notes to be dispensed are discharged out of the machine 5. The slot 8 is defined in a rotatable drum 9 spaced in a machine housing and coupled with a bank note depositing and dispensing mechanism. The bank note depositing and dispensing mechanism is composed of a bank note receiver 10 for receiving bank notes from the slot 8 and, an attraction drum 11 having on its outer periphery a bank note attraction unit for introducing one of the bank notes at a time from the bank note receiver 10, and a feeder 12 for feeding the bank notes from the attraction drum 11, and a discriminator 13 for checking the bank notes from the feeder 12 for their genuineness, face or bank, damage, and denomination, and a feeder 14 for feeding the bank notes checked by the discriminator 13, and a B pool 15 for temporarily storing bank notes which have been judged as being genuine, and a storage wheel 16 for storing genuine bank notes into the B pool 15, an A pool 17 for temporarily storing bank notes which have been judged as being false, and a storage wheel 18 for storing false bank notes, and a switching blade A for selectively delivering bank notes toward the B pool 15 and the A pool 17, and a feeder 19 for feeding bank notes from the feeder 14 to the switching blade A.

The bank note depositing and dispensing mechanism also comprises a common feeder 20 for returning bank notes which have been judged as being false, after they were repeatedly checked for a prescribed number of times, from the A pool 17 to the slot 8 and for delivering bank notes from the slot 8 to the bank note receiver 10 in order to store genuine bank notes or store bank notes delivered from the exterior delivery unit 6, and a feeder 21 for feeding bank notes which have been checked for their genuineness and for their denomination and damage to their respective containers, and a damaged bank note container 22 for storing those bank notes which have been judged as being damaged, and a switching blade B for directing damaged bank notes from the feeder 21 into the damaged bank note container 22, and a storage wheel 23 for storing bank notes in the damaged bank note container 22, and a thousand-yen bank note container 24 for storing thousand-yen bank notes, and a switching blade C for directing thousand-yen bank notes from the feeder 21 into the thousand-yen bank note container 24, and a storage wheel 25 for storing bank notes in the thousand-yen bank note container 24, and a ten-thousand-yen bank note container 26 for storing ten-thousand-yen bank notes, and a switching blade D for directing ten-thousand-yen bank notes from the feeder 21 into the ten-thousand-yen bank note container 26, and a storage wheel 27 for storing bank notes in the ten-thousand-yen bank note container 26.

The bank note depositing and dispensing mechanism further includes a deposit container 28 for storing five-thousand-yen bank notes and bank notes which have been judged as being genuine but undispensable, and a switching blade E for directing bank notes from the feeder 21 into the deposit container 28, and a storage wheel 29 for storing bank notes in the deposit container 28, and an attraction drum 30 disposed behind the storage wheel 25 for taking one thousand-yen bank note at a time from the thousand-yen bank note container 24 when they are to be dispensed or fed to the external delivery unit 6, and an attraction drum 31 disposed behind the storage wheel 27 for taking one ten-thousand-yen bank note at a time from the ten-thousand-yen bank note container 24, and an attraction drum 32 disposed behind the storage wheel 29 for taking one bank note at a time from the deposit container 28, and an attraction drum 33 disposed behind the storage wheel 23 for taking one damaged bank note at a time from the damaged bank note container 22, and a feeder 34 for feeding bank notes picked up by the attraction drums 30, 31, 32, 33 to the feeder 12.

The bank note depositing and dispensing mechanism also has a detector a for detecting when the thousand-yen bank note container 24 is full of thousand-yen bank notes, and a detector b for detecting when the thousand-yen bank note container 24 is short of thousand-yen bank notes, and a detector c for detecting when the ten-thousand-yen bank note container 26 is full of thousand-yen bank notes, and a detector d for detecting when the ten-thousand-yen bank note container 26 is short of ten-thousand-yen bank notes, and a detector e for detecting when the deposit container 28 is full of bank notes, and a detector f for detecting when the damaged bank note container 22 is full of bank notes, and detectors g and g' for detecting when bank notes have been completely charged through the slot 8, and a detector h for detecting when bank notes have been completely separated and delivered from the receiver 10, and a detector i for detecting when there is a bank note in the A pool 17, and a bank note transfer unit 35 for delivering bank notes to the external delivery unit 6 when the respective containers are filled with bank notes and for receiving bank notes from the external delivery unit 5 when the respective containers are short of bank notes, and a feeder 36 for feeding bank notes between the bank note transfer unit 35 and the B pool 15. The external delivery unit 6 may comprise a covered conveyor belt.

Figure 3:
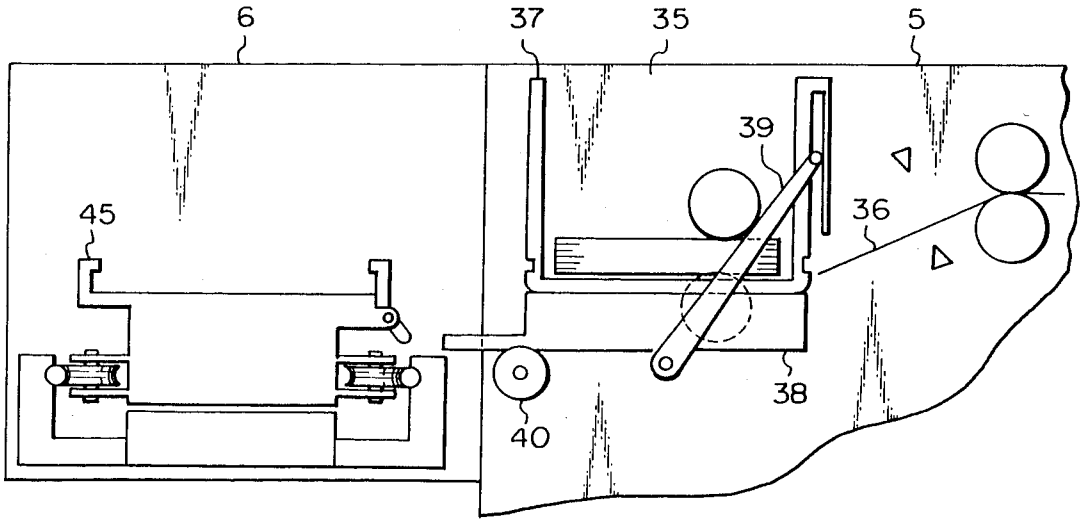
Figure 4:
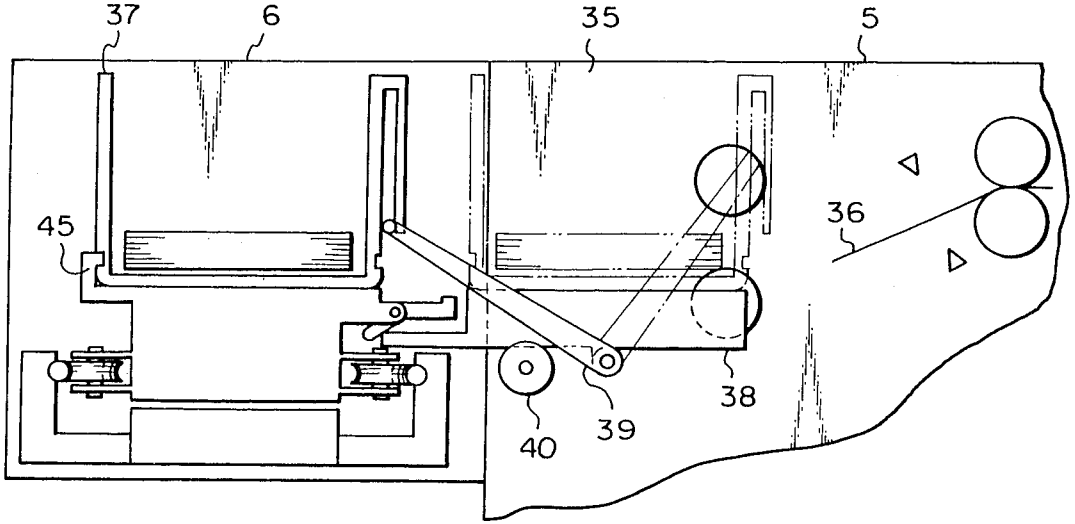
Figure 5:
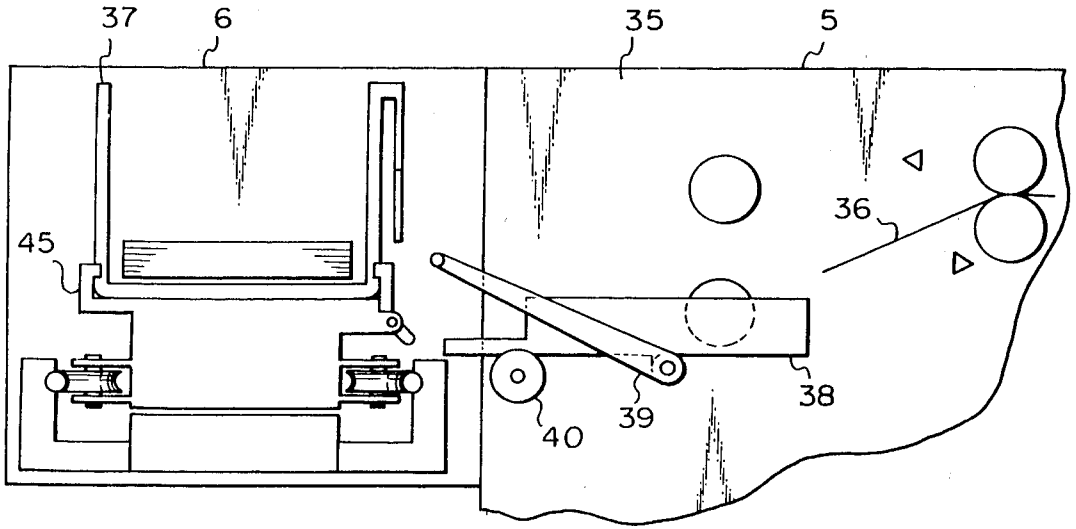

FIGS. 3 through 5 show the bank note transfer unit 35 in greater detail. The bank note transfer unit 35 is composed of a bank note container 37 which can be moved into and from the external delivery unit 6, and a base 38 for placing the bank note container 37 thereon, and a drive wheel 40 for moving the table 38 into the external delivery unit 6, and a link assembly 39 for moving the bank note container 37 into and from the external delivery unit 6.

Figures 6, 6A:
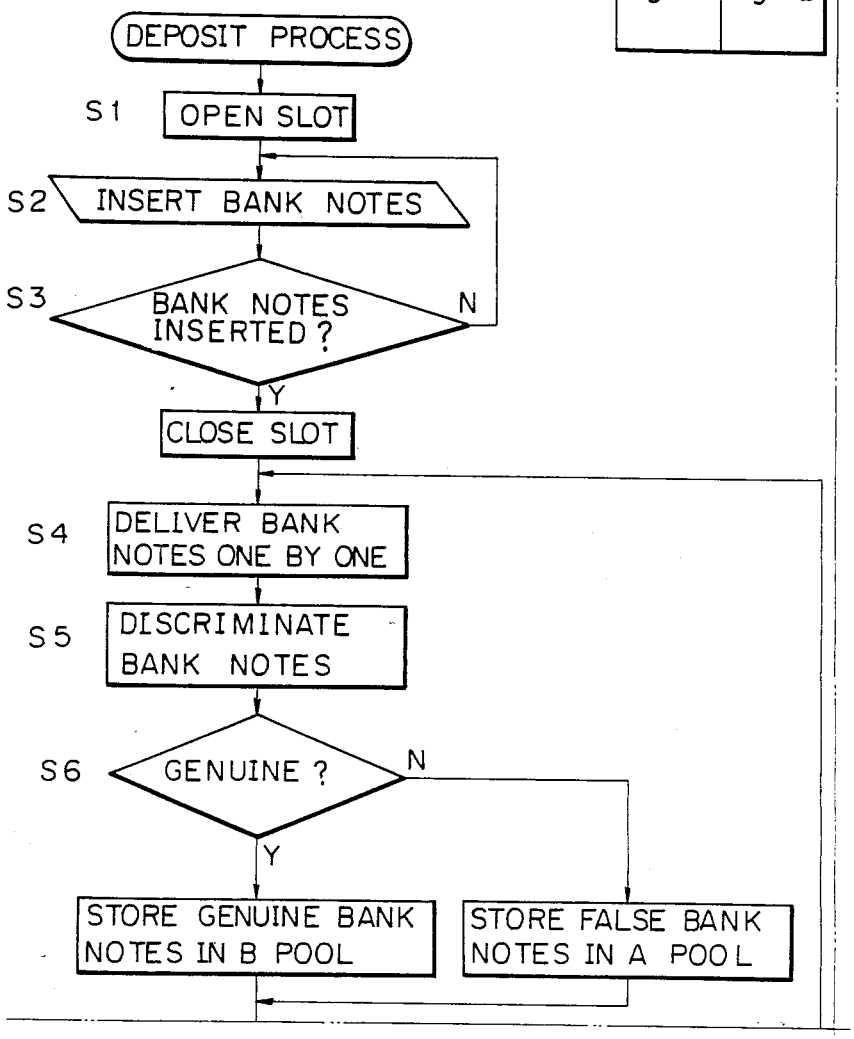
FIGS. 6 through 8 are flowcharts of the operation of the bank note depositing and dispensing machine.
Figure 6B:
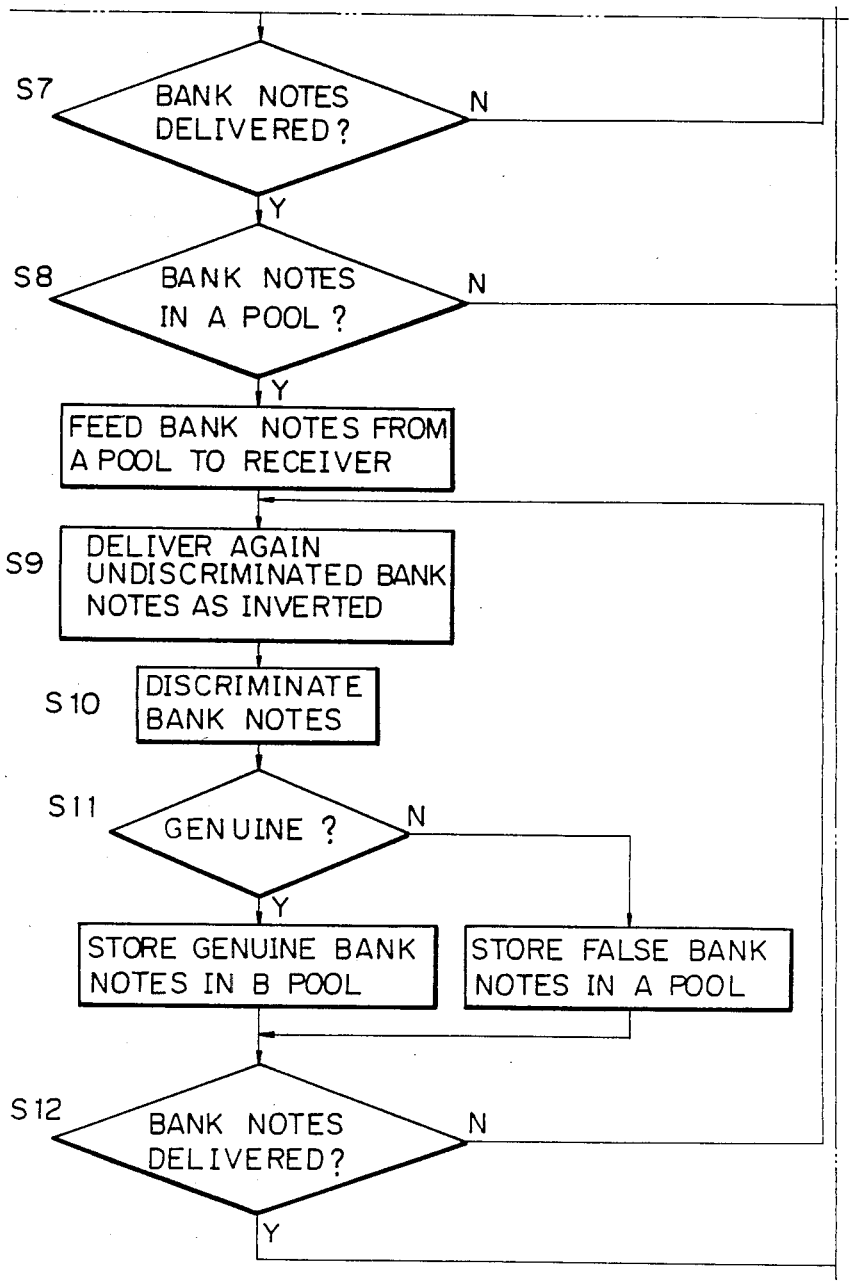
Figure 6C:
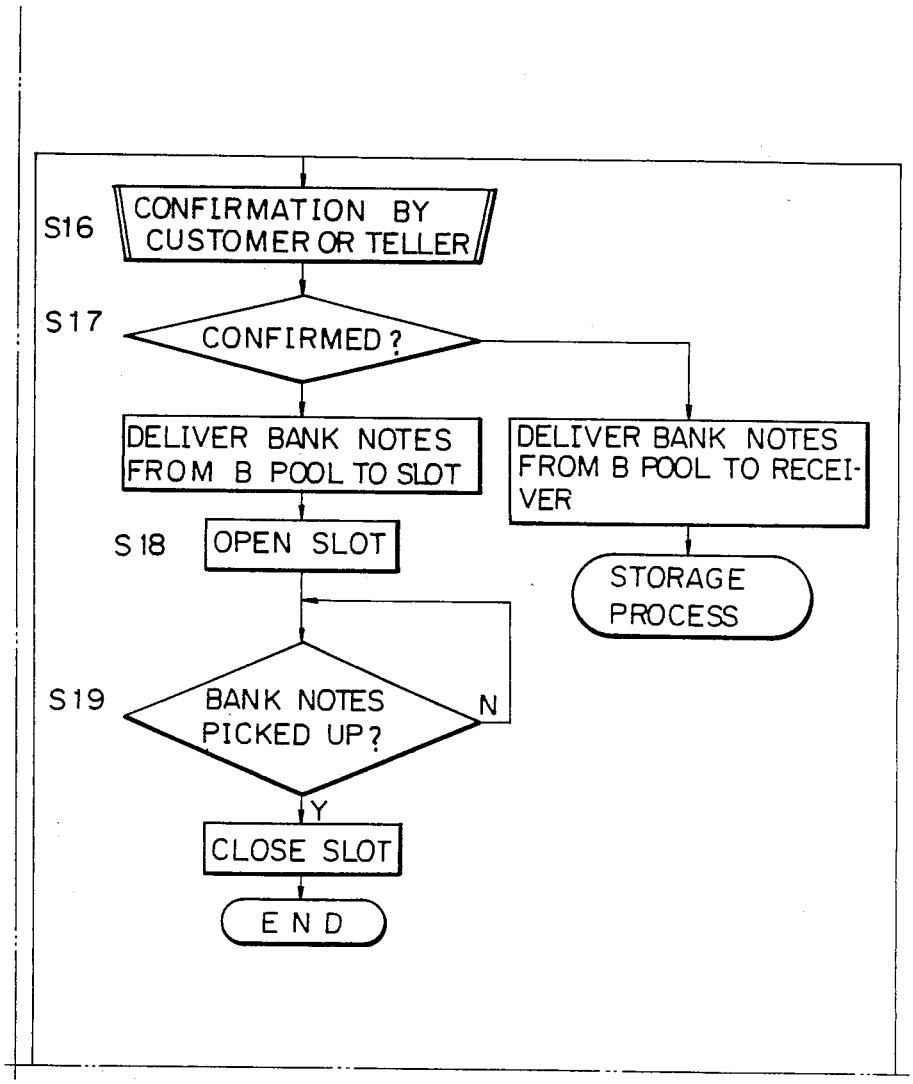
Figure 6D:
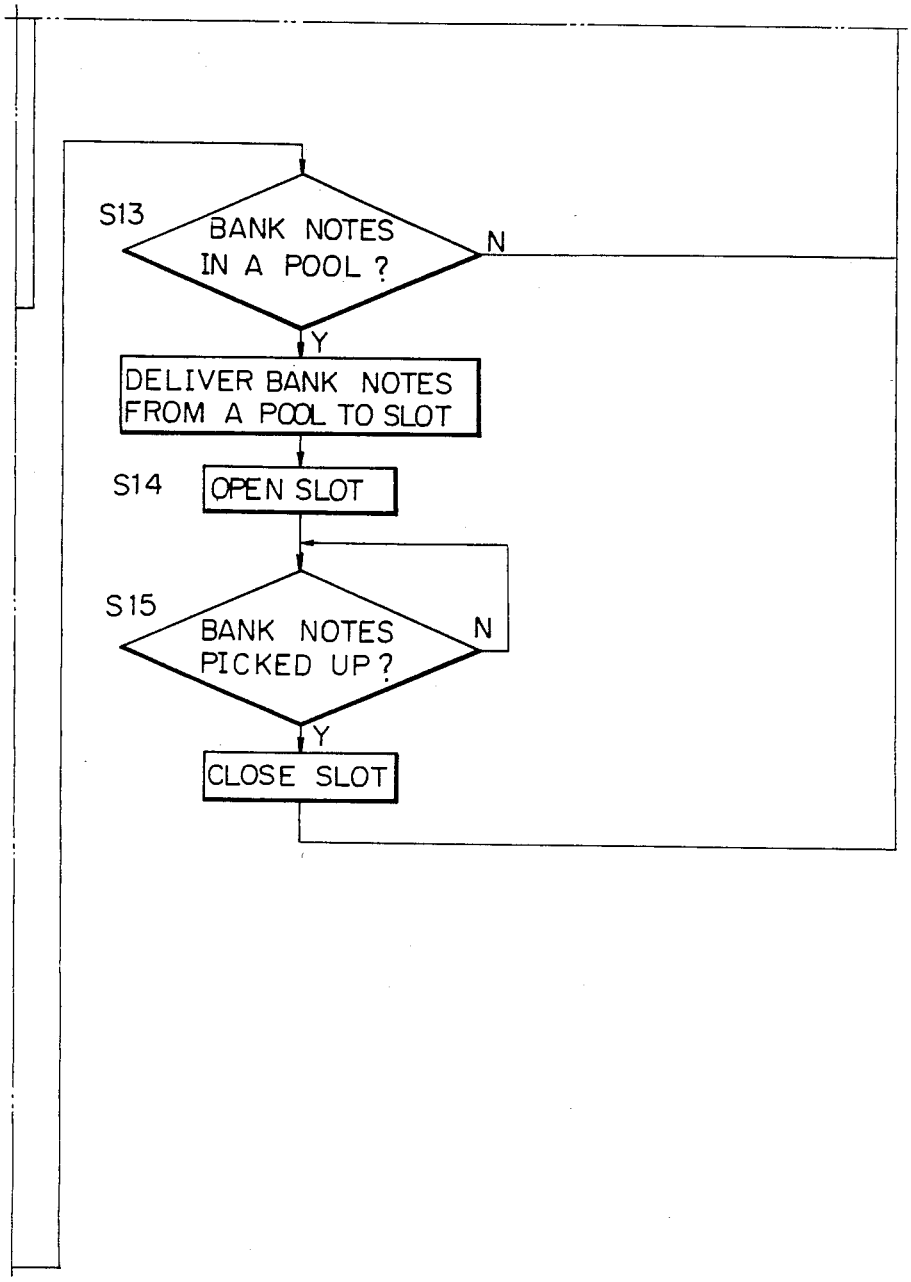
Figures 7, 7A:
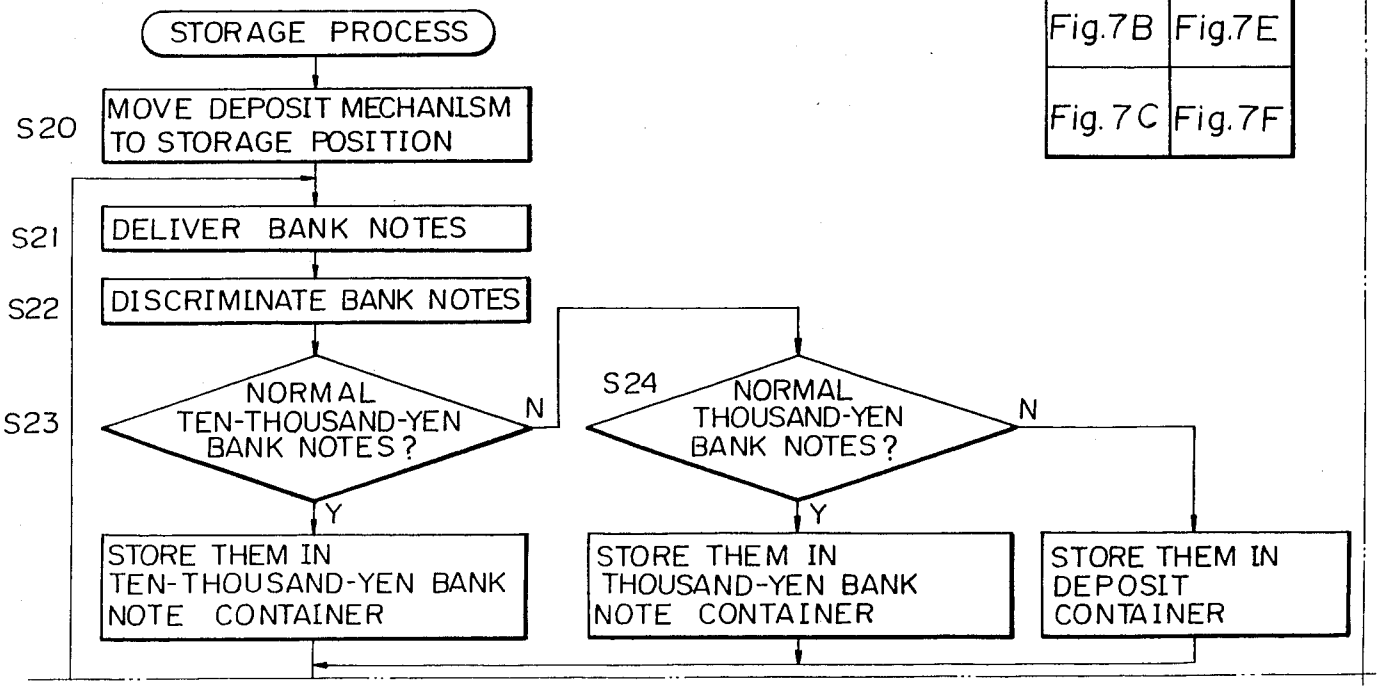
Figure 7B:
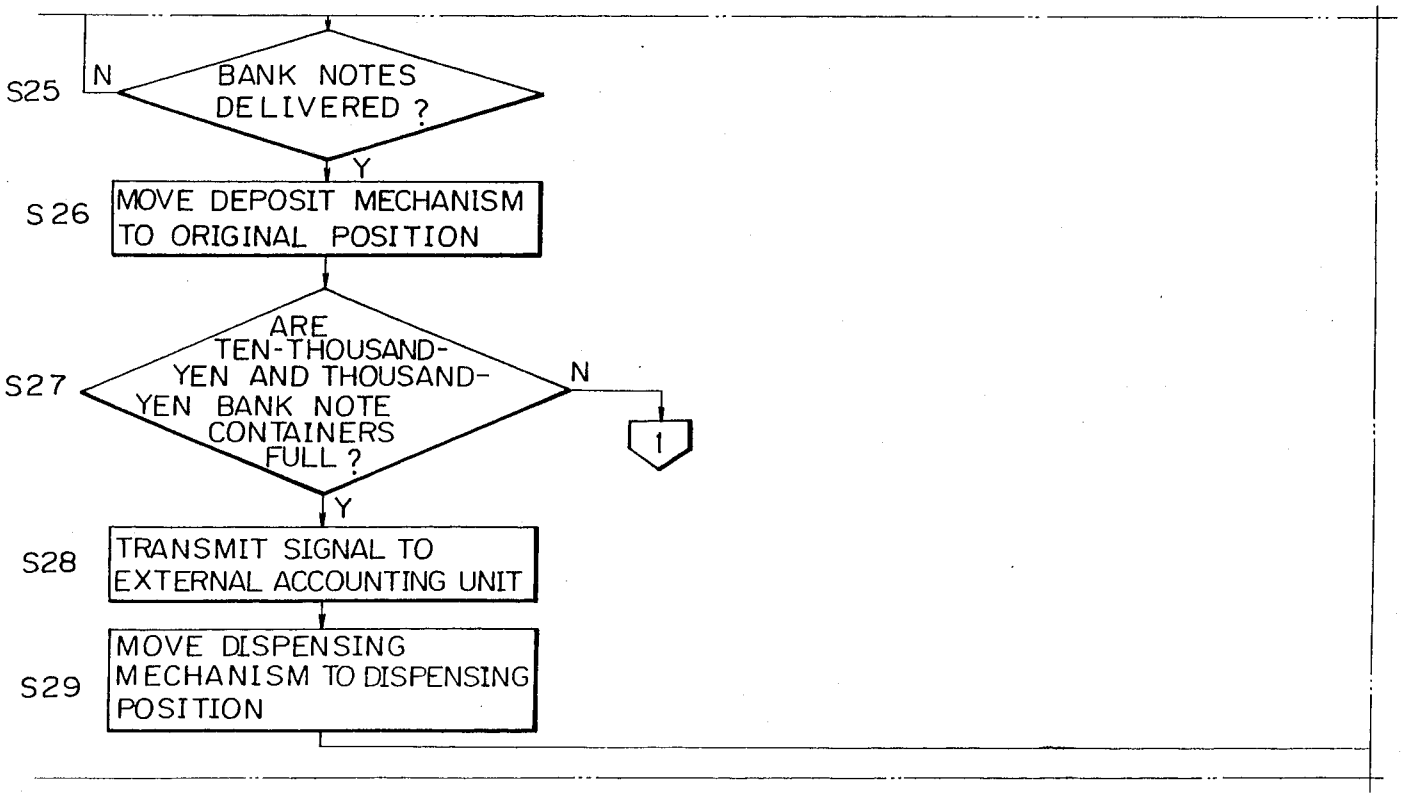
Figure 7C:
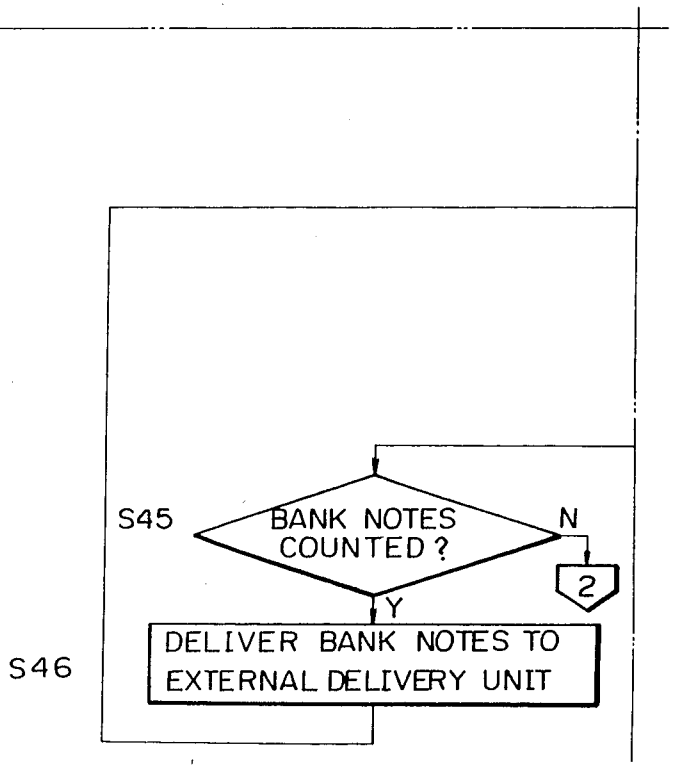
Figure 7D:
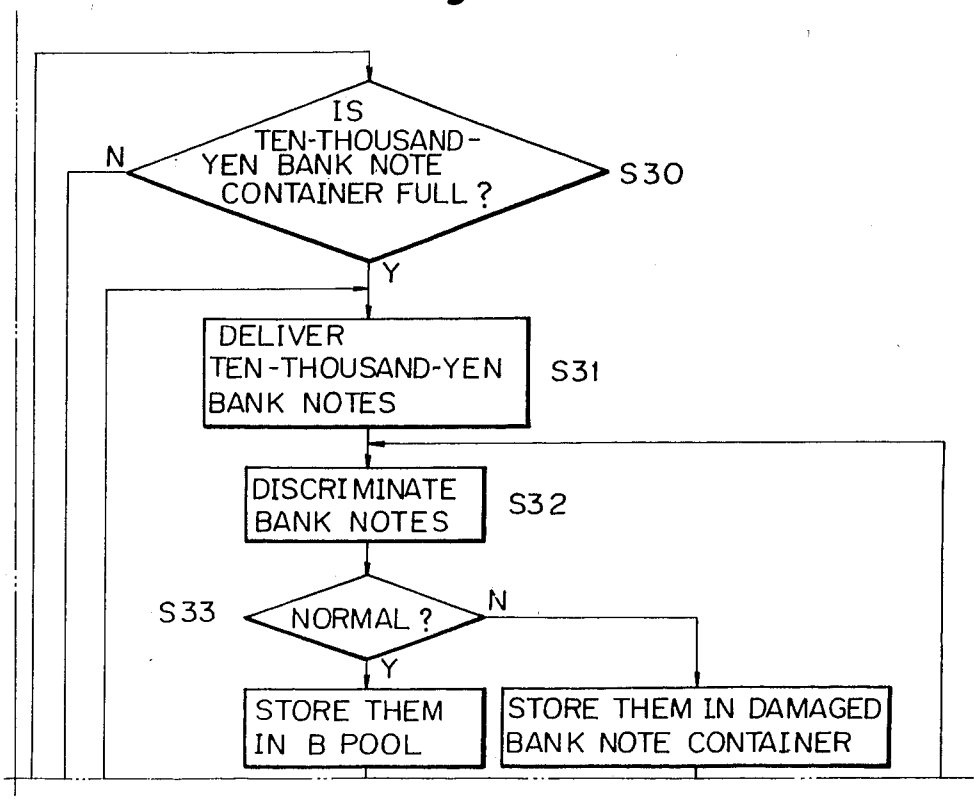
Figure 7E:
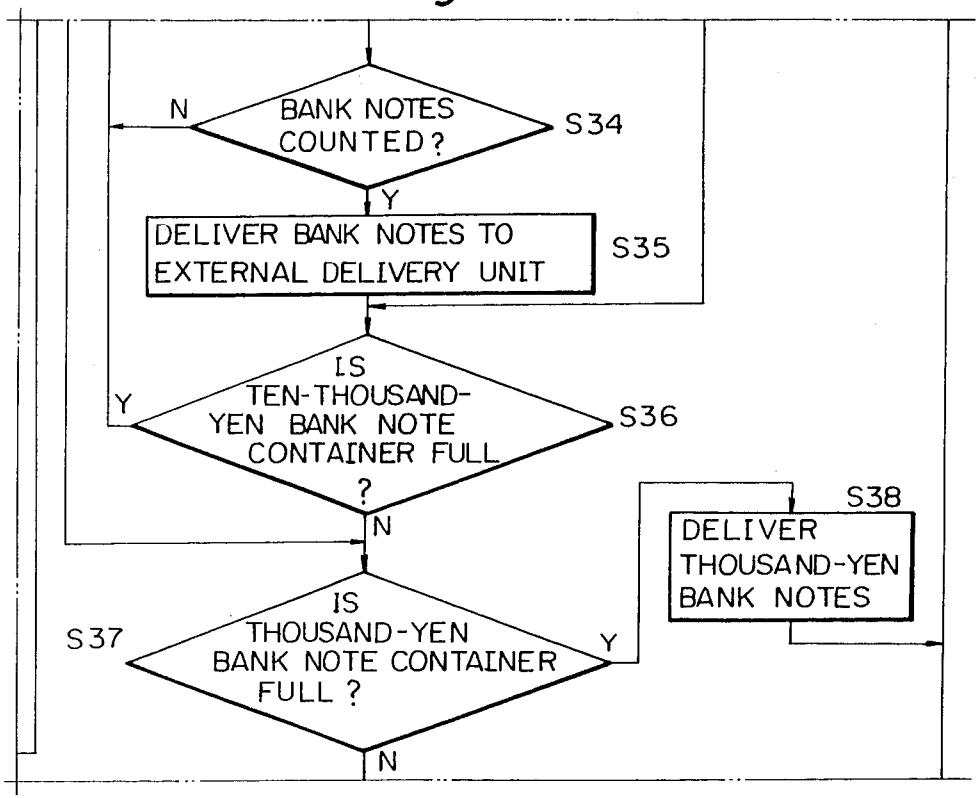
Figure 7F:
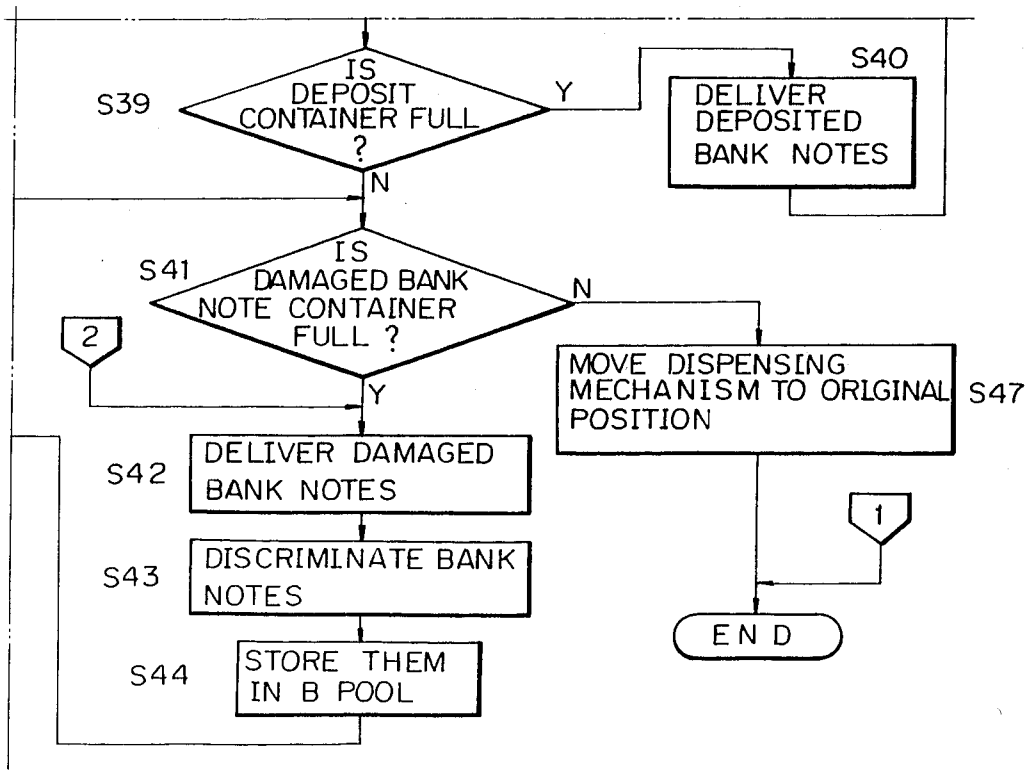
Figures 8, 8A:
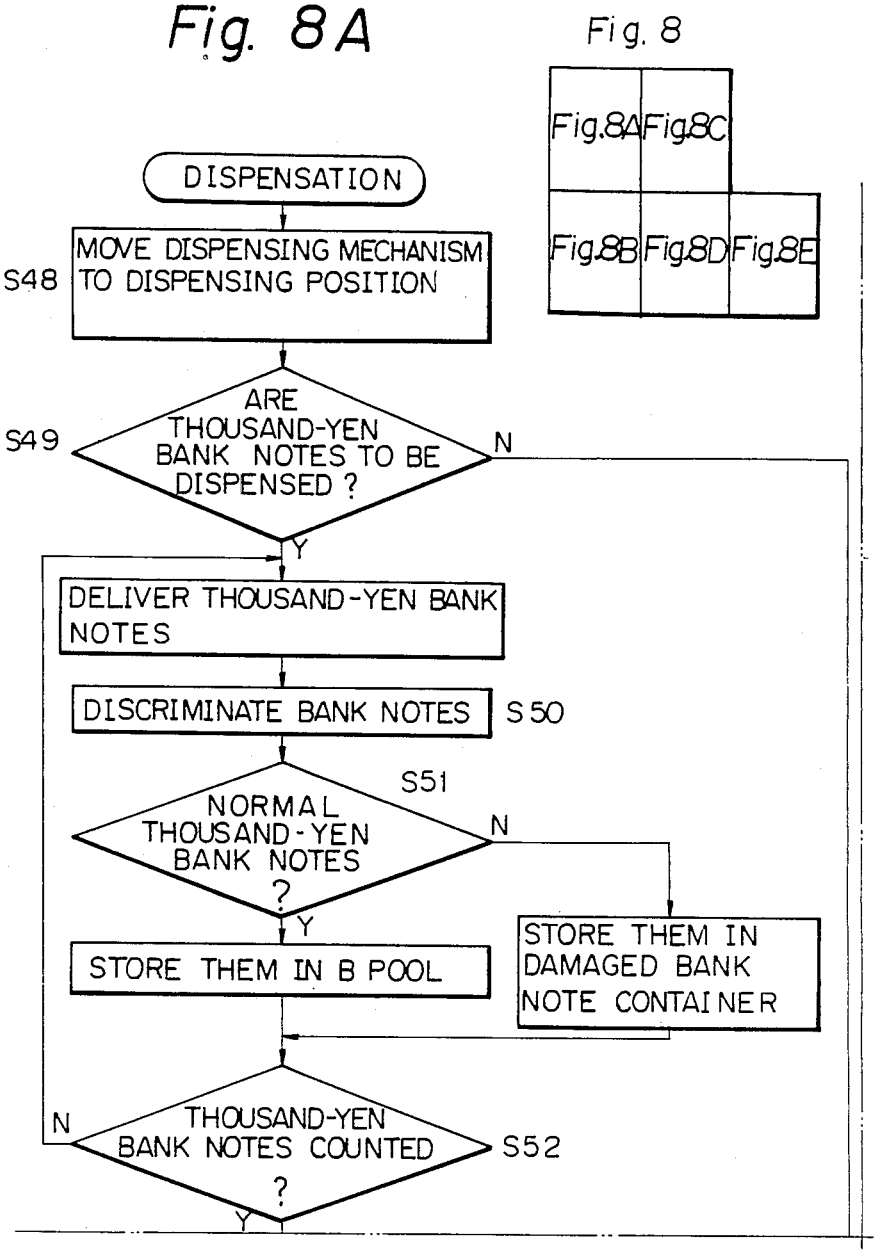
Figure 8B:
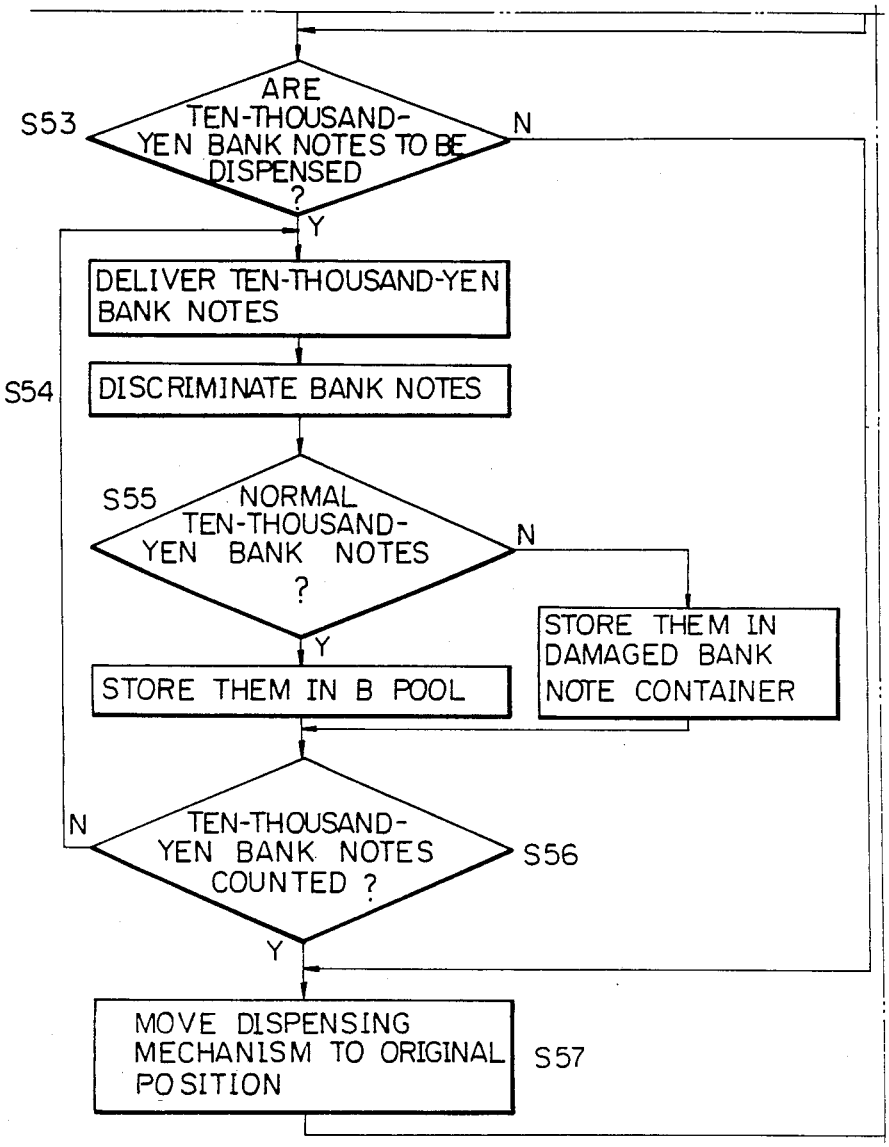
Figure 8C:
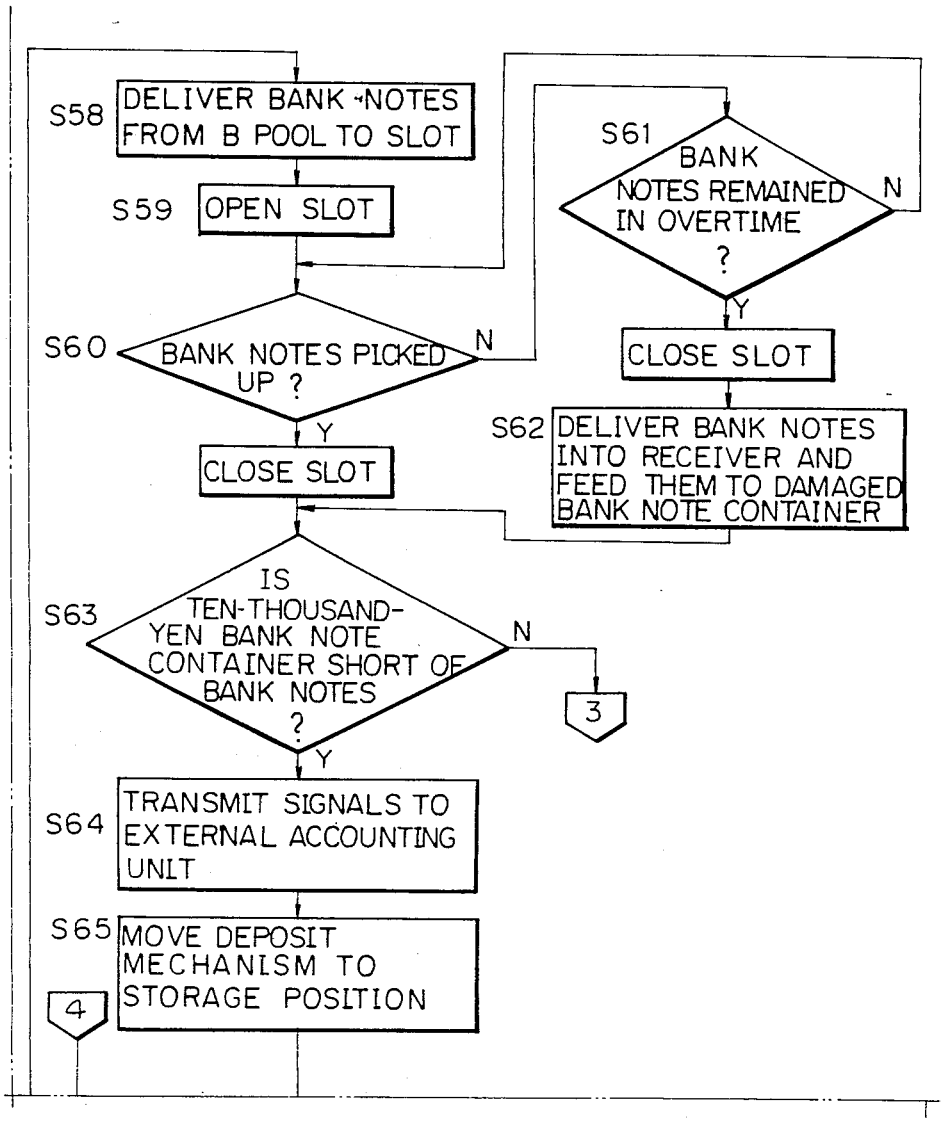
Figure 8D:
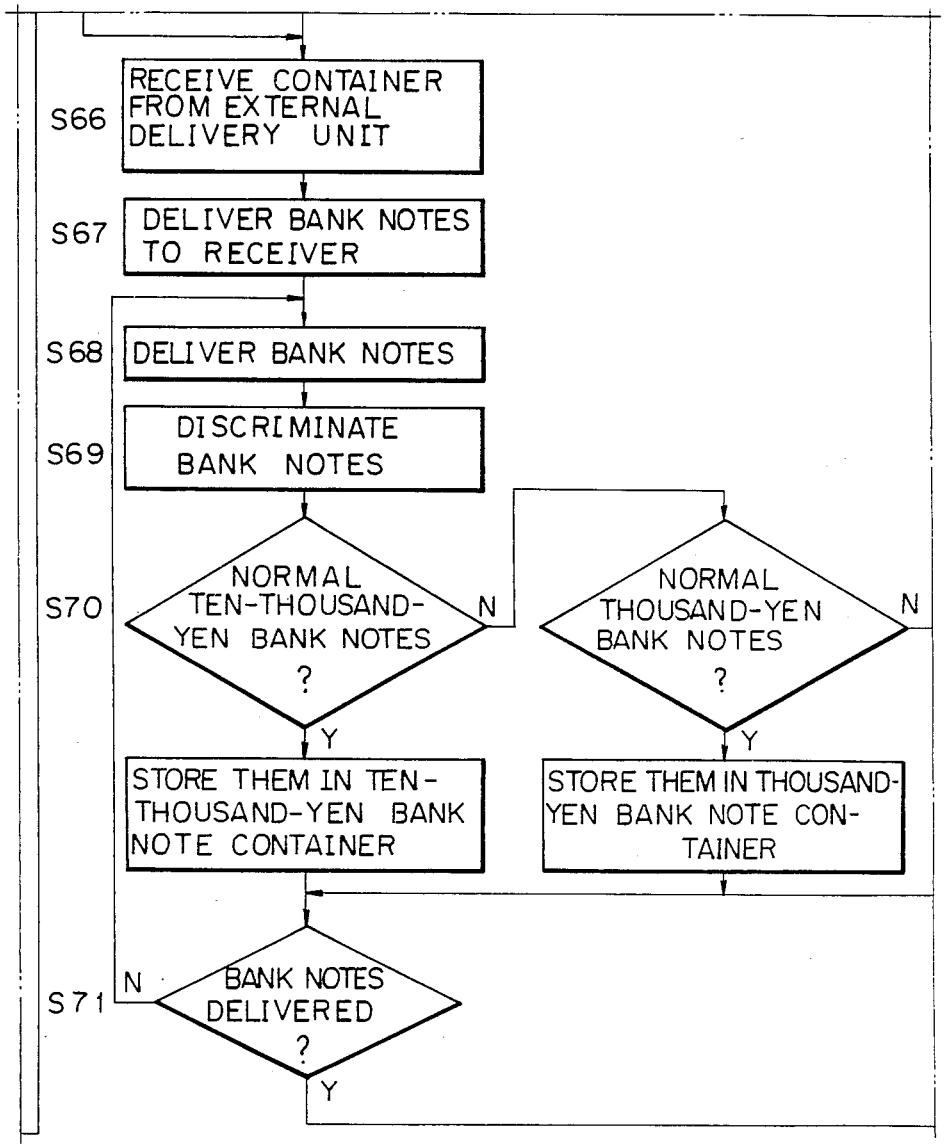
Figure 8E:
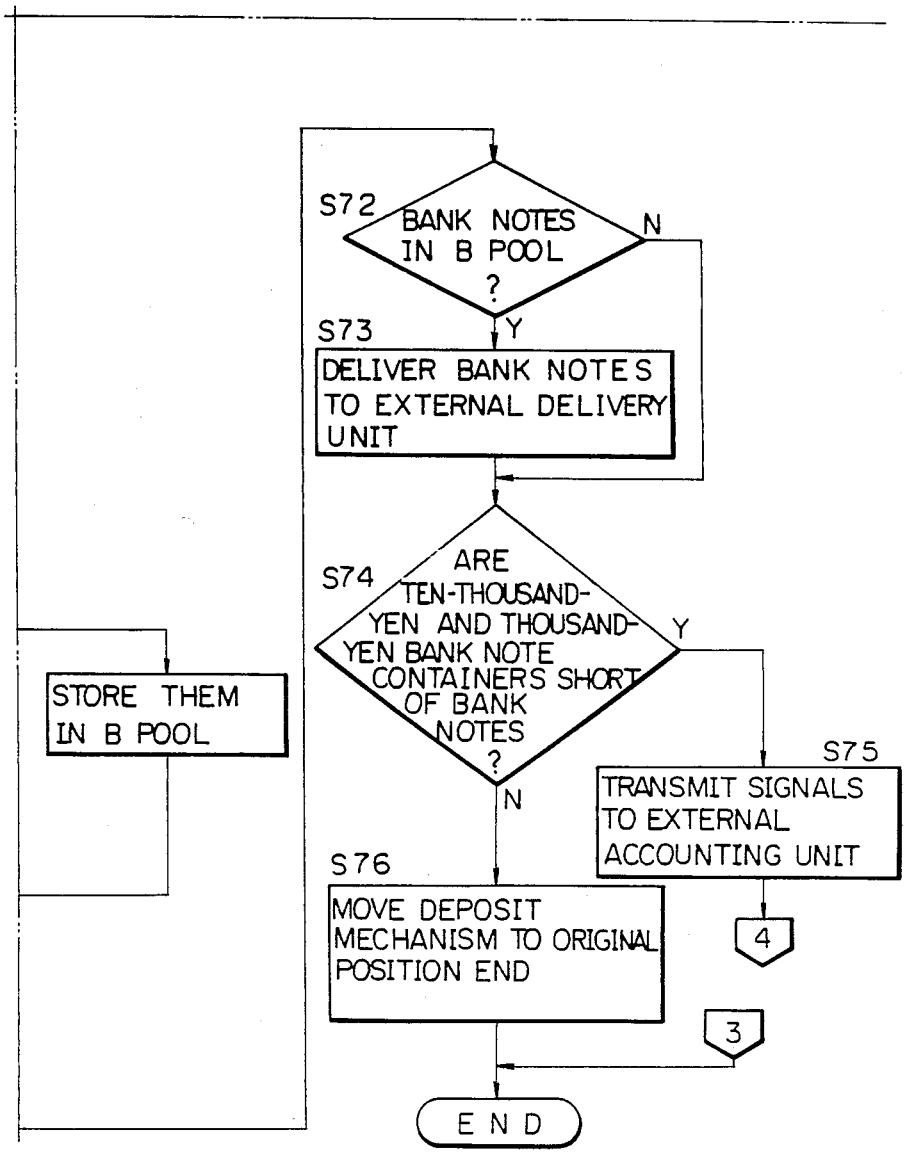

FIGS. 6 through 8 are flowcharts of a procedure for progressively processing bank notes in the arrangements shown in FIGS. 1 through 5 under the control of a controller. The operation of the automatic bank note depositing and dispensing machine will be described with reference to the flowcharts of FIGS. 6 through 8, the operation being broken down into "deposit", "storage", and "dispensation" processes for explanation.

(DEPOSIT)

Step S1:

When a signal for effecting a deposit is issued from the controller, a shutter for the slot 8 is opened.

Step S2:

Bank notes are inserted into the slot 8.

Step S3:

The detectors g and g' at the slot 8 detect whether the bank notes have been completely charged or not. If not, then the shutter is kept open for a prescribed period of time, and if all of the bank notes have been inserted, then the shutter for the slot 8 is closed.

Step S4:

The bank notes are delivered in a lump from the slot 8 into the receiver 10, and then fed out of the receiver 10 one by one by the attraction drum 11.

Step S5:

The discriminator 13 checks if the bank notes are genuine or false (first bank note checking process).

Step S6:

Those bank notes which are judged as being genuine are stored in the B pool 15, and those which are judged as being false are stored in the A pool 17.

Step S7:

The detector h at the receiver 10 checks if the bank notes have been completely delivered. If not, then the bank notes are continuously separated and delivered. If they have been completely delivered, then the detector i at the A pool 17 checks the A pool 17 for any bank note therein.

Step S8:

If there is any bank note judged as being false in the A pool 17, then it is delivered by the feeder 20 into the receiver 10 through the slot 8 in the drum 9. If not, then control goes to a step S16. The drum 9 is rotatable to direct the slot 8 selectively toward the depositor, the receiver 10, and the feeder 20.

Step S9:

Those bank notes which cannot be discriminated are separated and delivered again. At this time, the bank notes are reversed and turned up side down transversely.

Step S10:

The discriminator 13 checks the bank notes for their genuineness.

Step S11:

Those bank notes which are judged as being genuine are stored in the B pool 15, and those which are judged as being false are stored in the A pool 17.

Step S12:

The receiver 10 is checked for the completion of bank note separation and delivery. If the bank notes have not been completely separated and delivered, then they are continuously separated and delivered. If the bank notes have completely been separated and delivered, then the A pool 17 is checked for any bank note stored therein which has been judged as being false.

Step S13:

If there is a bank note in the A pool 17, then it is fed back to the slot 8, and if not, control goes to the step S16.

Step S14:

The shutter for the slot 8 is opened.

Step S15:

The slot 8 is checked by the detectors g and g' for the completion of picking up of the returned bank note. If the returned bank note has not been picked up, then the shutter for the slot 8 remains open for a prescribed period of time, and if it has been picked up, then the shutter is closed.

Step S16:

The sum of the deposited bank notes is displayed and the depositor or teller is urged to confirm the displayed deposited sum.

Step S17:

If the displayed sum is confirmed, then the deposited bank notes are fed from the B pool 15 through the feed 20 and the slot 8 into the receiver 10 for storage. If not confirmed, the bank notes are fed back from the B pool 15 to the slot 8 for return.

Step S18:

The shutter for the slot 8 is opened.

Step S19:

The detectors g and g' check if the returned bank notes have been picked up. If not, then the shutter for the slot 8 remains open, and if completed, then the shutter is closed to thereby complete the depositing process.

(STORAGE)

Step S20:

The storage wheels 24, 27, 29, and a stage 41 in the thousand-yen bank note container 24, and a stage 42 in the ten-thousand-yen bank note container 26, and a stage 43 in the deposit container 28 are moved to their positions for storing bank notes.

Step S21:

The bank notes are separated and delivered out of the receiver 10.

Step S22:

The discriminator 13 checks the bank notes for damage and denomination (second bank note checking process).

Step S23:

Normal ten-thousand-yen bank notes are stored through the feeders 14, 21 in the ten-thousand-yen bank note container 26, and those bank notes which are not normal are processed in a step S24.

Step S24:

Normal thousand-yen bank notes are stored through the feeders 14, 21 in the thousand-yen bank note container 24, and those bank notes which are not normal thousand-yen bank notes are stored into the deposite container 28.

Step S25:

The receiver 10 is checked for the completion of bank note separation and delivery. If completed, then control goes to a step S26, and if not, then control goes back to the step S21 for continued bank note separation and delivery.

Step S26:

The storage wheels 25, 27, 29 and the stages 41, 42, 43 are moved bank to their original positions.

Step S27:

The detectors c, a, e check if the ten-thousand-yen bank note container 26, the thousand-yen bank note container 24, and the deposit container 28 are full of bank notes. If they are full of bank notes, then control goes to a step S28, and if not the storage process is brought to an end.

Step S28:

The controller issues signals to the external accounting units 7 to collect ten-thousand-yen bank notes, thousand-yen bank notes, and deposited bank notes. A delivery base 45 in the external delivery unit 6 is moved toward the bank note transfer unit 35.

Step S29:

The stages 41, 42, 43 are moved to their dispensing positions. The storage wheel 23 and a stage 44 in the damaged bank note container 22 are moved to positions for storing bank notes.

Step S30:

If the ten-thousand-yen bank note container 26 is full of bank notes, then control goes to a step S31, and if not, then control goes to a step S37.

Step S31:

The ten-thousand-yen bank notes are separated and delivered one by one from the ten-thousand-yen bank note container 26.

Step S32:

The discriminator 13 checks if the bank notes are normal or damaged (second bank note checking process).

Step S33:

Bank notes which are normal are stored in the B pool 15, and bank notes which are damaged are stored in the damaged bank note container 22.

Step S34:

If the number of bank notes stored in the B pool 15 reaches a predetermined number, then control goes to a step S35, and if not, then control goes back to the step S31.

Step S35:

The bank notes are fed from the B pool 15 through the feeder 36 into the container 37 in the bank note transfer unit 35. The drive wheel 40 is rotated counterclockwise (FIGS. 3 and 4) to move the base 38 toward the external delivery unit 6, and the link assembly 39 pivotally mounted on the base 38 is rotated counterclockwise to move the container 37 onto the delivery base 45 in the external delivery unit 6. After the delivery base 45 ahs been moved toward the external accounting unit and collected bank notes, the delivery base 45 is moved toward the bank note transfer unit 35 to place the container 37 back in the bank note transfer unit 35.

Step S36:

If the ten-thousand-yen bank note container 26 is full of bank notes, then control returns to the step S31, and if not, then control goes to the step S37.

Step S37:

If the thousand-yen bank note container 24 is full of bank notes, then control goes to a step S38, and if not, then control goes to a step S39.

Step S38:

The thousand-yen bank notes are separated and delivered one by one from the thousand-yen bank note container 24.

Step S39:

If the deposit container 28 is full of bank notes, then control goes to a step S40, and if not, then control goes to a Step S41.

Step S40:

The deposited bank notes are separated and fed one by one from the deposit container 28.

Step S41:

If the damaged bank note container 22 is full of bank notes, then the storage wheel 23 and the stage 44 are moved to the dispensing positions and control goes to a step S42, and if not, then control goes to a step S47.

Step S42:

The damaged bank notes are separated and delivered one by one from the damaged bank note container 22.

Step S43:

The discriminator 13 checks the bank notes for damage.

Step S44:

The bank notes having passed through the discriminator 13 are stored into the B pool 15.

Step S45:

If the number of bank notes stored in the B pool 15 reaches a predetermined number, then control goes to a step S46, and if not, control goes bank to the step S42.

Step S46:

The bank notes from the B pool 15 are delivered through the feeder 36, the bank note transfer unit 35, the container 37 and collected via the external delivery unit 6 in the external accounting unit 7. Then, the container 37 is placed back into the bank note transfer unit 35. Control goes back to the step S41.

Step S47:

The stages 44, 41, 42, 43 are moved back to their original positions, whereupon the storage process is finished.

(DISPENSATION)

Step S48:

The stages 41, 42 are moved to the dispensing positions, and the storage wheel 23 and the stage 44 are moved to the depositing positions.

Step S49:

Control checks if thousand-yen bank notes are to be dispensed. If not, then control goes to a step S53, and if thousand-yen bank notes are to be dispensed, then thousand-yen bank notes are delivered one by one from the thousand-yen bank note container 24.

Step S50:

The discriminator 13 checks if the thousand-yen bank notes are normal or damaged.

Step S51:

Thousand-yen bank notes which are found to be normal are stored into the B pool 15, and thousand-yen bank notes which are found to be damaged are stored in the damaged bank note container 22.

Step S52:

Control checks if the thousand-yen bank notes have been counted. If counted, then control goes to a step S53, and if not, then control goes to the step S49 for separation and delivery.

Step S53:

Control checks if ten-thousand-yen bank notes are to be dispensed, If they are to be dispensed, then the ten-thousand-yen bank notes are delivered one by one from the ten-thousand-yen bank note container 26, and if not, then control goes to a step S57.

Step S54:

The discriminator 13 checks if the ten-thousand-yen bank notes are normal or damaged.

Step S55:

Ten-thousand-yen bank notes which are found to be normal are stored into the B pool 15, and ten-thousand-yen bank notes which are found to be damaged are stored into the damaged bank note container 22.

Step S56:

Control checks if the ten-thousand-yen bank notes have been counted. If counted, then control goes to the step S57, and if not, then control goes to the step S53 for separation and delivery.

Step S57:

The stages 41, 42, the storage wheel 23, and the stage 44 are moved to the original positions.

Step S58:

The bank notes are delivered from the B pool 15 through the feeder 20 to the slot 8.

Step S59:

The shutter for the slot 8 is opened.

Step S60:

The slot 8 is checked for the picking up of the bank notes. If they have been picked up, then the shutter for the slot 8 is closed and control goes to a step S63. If not, then control proceeds to a step S61.

Step S61:

The time for which the bank notes are present in the slot 8 is measured. If the time in which the bank notes remain in the slot 8 is in excess of a predetermined time, then the shutter for the slot 8 is closed and control goes to a step S62, and if not, then control goes back to the step S60.

Step S62:

The storage wheel 23 and the stage 44 are moved to the depositing positions to introduce the remaining bank notes into the receiver 10 from which they are delivered out one by one. The bank notes are then stored through the discriminator 13 into the damaged bank note container 22. After they have been stored in the damaged bank note container 22, the storage wheel 23 and the stage 44 are moved to the original positions, and control goes to a step S63.

Step S63:

The detectors d and b check if the ten-thousand-yen bank note container 26 and the thousand-yen bank note container 24 are running short of bank notes. If so, then control goes to a step S64, and if not, then the depositing process is completed.

Step S64:

The controller issues signals indicating the required denominations and the number of required bank notes to the external accounting unit 7. After the container 37 has been placed on the transfer base 45 in the external transfer unit 6, the container 37 is moved to the external accounting unit 7 where the container 37 is supplied with the required bank notes indicated by the signals. Then, the container 37 is moved through the external delivery unit 6 back to the bank note transfer unit 35.

Step S65:

The storage wheels 25, 27 and the stages 41, 42 are moved to the depositing positions.

Step S66:

The container 37 is moved by the drive wheel 40, the base 38, and the link assembly 39 from the transfer base 45 back into the bank note transfer unit 35.

Step S67:

The bank notes are fed in a lump from the container 37 through the feeder 36, the B pool 15, the A pool 17, the feeder 20, and the slot 8 into the receiver 10.

Step S68:

The bank notes are then delivered one by one from the receiver 10.

Step S69:

The discriminator 13 checks the bank notes for denomination and damage.

Step S70:

Bank notes which are found to be normal ten-thousand-yen bank notes are stored in the ten-thousand-yen bank note container 26, and bank notes which are found to be normal thousand-yen bank notes are stored in the thousand-yen bank note container 24. Any damaged bank notes are stored into the B pool 15.

Step S71:

The detector h checks if the bank notes have been completely discharged out of the receiver 10. If completely delivered, then control goes to a step S72, and if not, then control returns to the step S68.

Step S72:

The B pool 15 is checked for any bank note therein. If there is any bank note therein, then control goes to a step S73, and if not, then control goes to a step S74.

Step S73:

The bank notes are delivered from the B pool 15 through the feeder 36, the bank note transfer unit 35, and the container 37, and collected via the external delivery unit 6 in the external accounting unit 7. Thereafter, the container 37 is placed back into the bank note transfer unit 35.

Step S74:

The detectors d and b check if the ten-thousand-yen bank note container 26 and the thousand-yen bank note container 24 are running short of bank notes. If so, then control goes to a step S75, and if not, then control goes to a step S76.

Step S75:

The controller issues signals indicating the required denominations and the number of required bank notes to the external accounting unit 7. After the container 37 has been placed on the transfer base 45 in the external transfer unit 6, the container 37 is moved to the external accounting unit 7 where the container 37 is supplied with the required bank notes indicated by the signals. Then, the container 37 is moved through the external delivery unit 6 bank to the bank note transfer unit 35. Control goes back to the step S66.

Step S76:

The storage wheels 25, 27 and the stages 41, 42 are moved to the depositing positions. The dispensing process is now completed.

Figure 9:
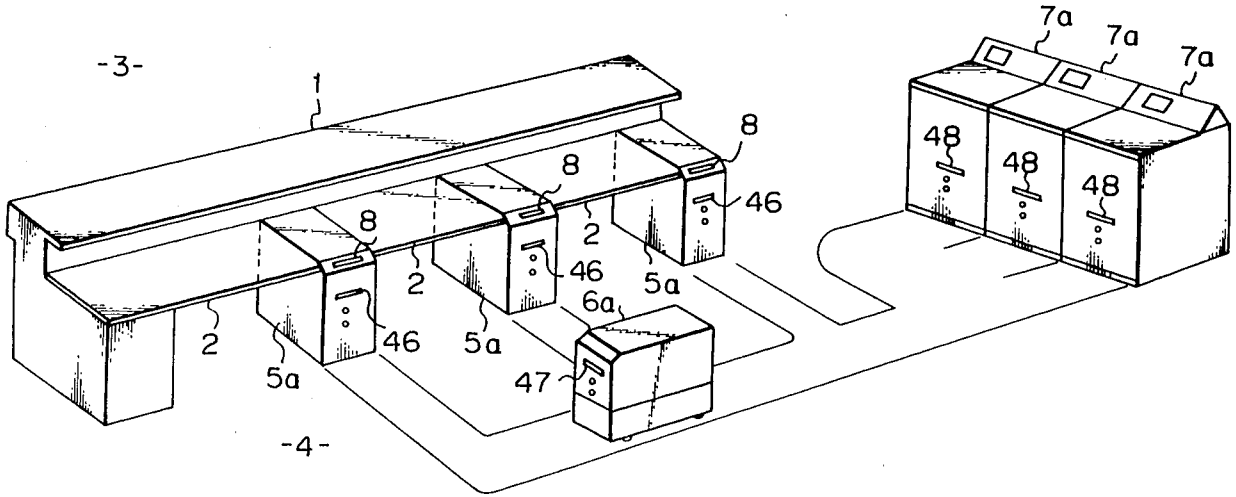
FIG. 9 is a perspective view of a system according to another embodiment of the present invention, comprising bank note depositing and dispensing machines at teller's cages, a self-propelled vehicle with a bank note depositing and dispensing device, and external accounting units.
Figure 10:
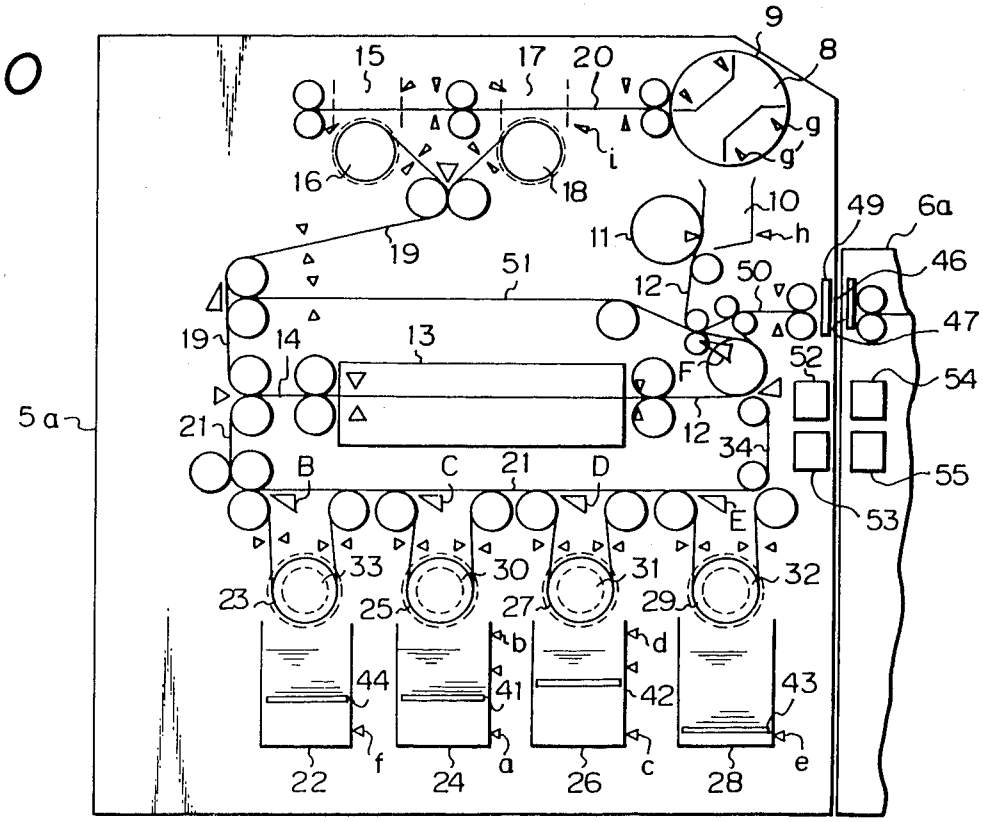
FIG. 10 is a schematic side elevational view of an internal mechanism of each of the bank note depositing and dispensing machines shown in FIG. 9.

FIGS. 9 and 10 illustrate bank note depositing and dispensing machines 6*a* at teller's cages, a self-propelled vehicle 6*a* with a bank note depositing and dispensing machine, serving as an external delivery unit, and external accounting units 7*a*.

Since the system shown in FIGS. 9 and 10 is substantially similar to that shown in FIGS. 1 and 2, only different components will be described hereinbelow. The self-propelled vehicle 6*a* is movable on the floor 4 between the bank note depositing and dispensing machines 5*a* and the external accounting units 7*a*. When the self-propelled vehicle 6*a* is coupled to one of the bank note depositing and dispensing machines 5*a*, bank notes are transferred between the machine 5*a* and the self-propelled vehicle 6*a* through a transfer slot 47 in the vehicle 6*a* and a transfer slot 46 in the machine 5*a*, the transfer slot 46 being located on the same side as that on which the slot 8 is positioned. When the self-propelled vehicle 6*a* is coupled to one of the external accounting units 7*a*, bank notes are transferred between the machine 5*a* and the external accounting units 7*a* through the transfer slot 47 in the vehicle 6*a* and a transfer slot 48 in the external accounting units 7*a*.

As shown in FIG. 10, each of the bank note depositing and dispensing machines 5*a* differs from the bank note depositing and dispensing machine 5 shown in FIGS. 1 and 2 in that the bank note depositing and dispensing machine 5*a* does not have the feeder 36 and the bank note transfer unit 35, but has a shutter 49 for opening and closing the transfer slot 46, the transfer slot 46 serving to deliver bank notes to the vehicle 6*a* when the respective containers 22, 24, 26, 28 are full of bank notes and also to receive bank notes from the vehicle 6*a* when the respective containers 22, 24, 26, 28 are short of bank notes, a feeder 50 for delivering bank notes from and to the transfer slot 46, a feeder 51 for delivering bank notes from the discriminator 13 through the feeders 14, 19 to the feeder 50 when the containers 22, 24, 26, 28 are full of bank notes, a switching blade F for directing bank notes from the feeder 51 toward the feeder 50 and also for directing bank notes from the feeder 56 toward the feeder 12, a signal transmitter and receiver 52 for transmitting signals to and receiving signals from the self-propelled vehicle 6*a*, and a power supply unit 53 for supplying electric power to the self-propelled vehicle 6*a*. The self-propelled vehicle 6*a* has a signal transmitter and receiver 54 for transmitting signals to and receiving signals from the signal transmitter and receiver 52 in the machine 5*a*, and a power supply unit 53 for receiving electric power from the power supply unit 53 in the machine 5*a*.

Figures 11, 11A:
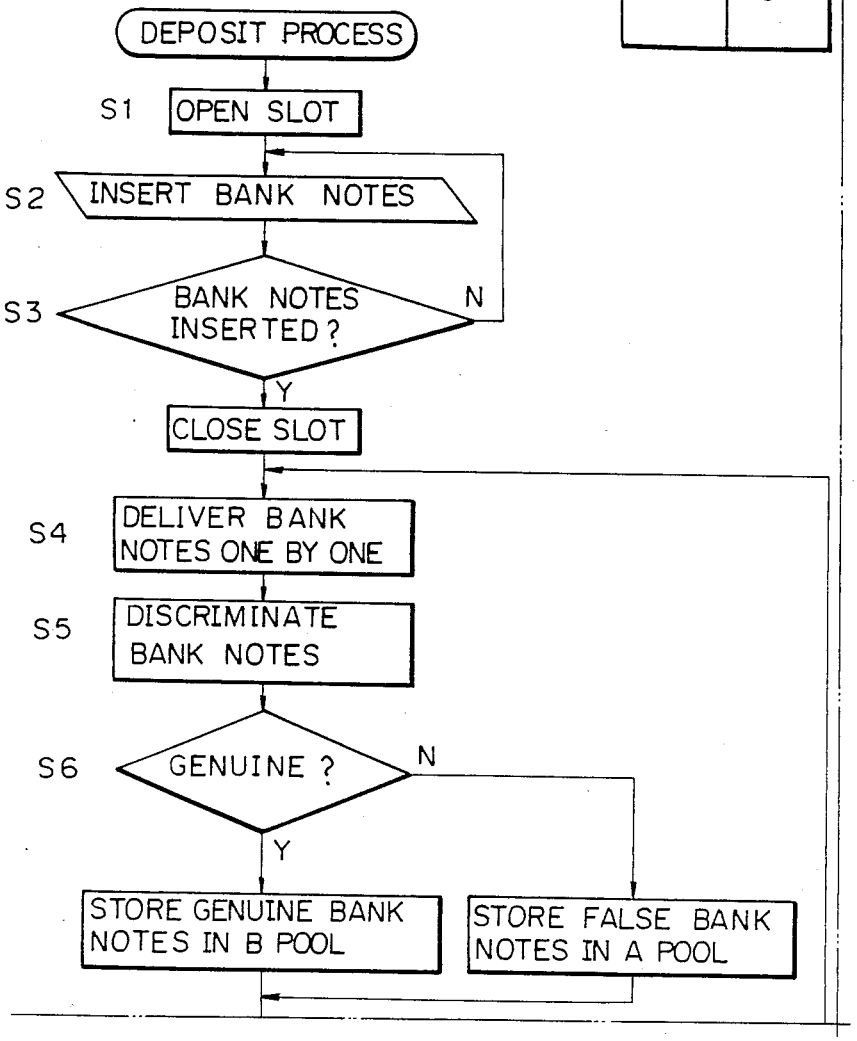
FIGS. 11 through 13 are flowcharts of the operation of the bank note depositing and dispensing machine shown in FIG. 9.
Figure 11B:
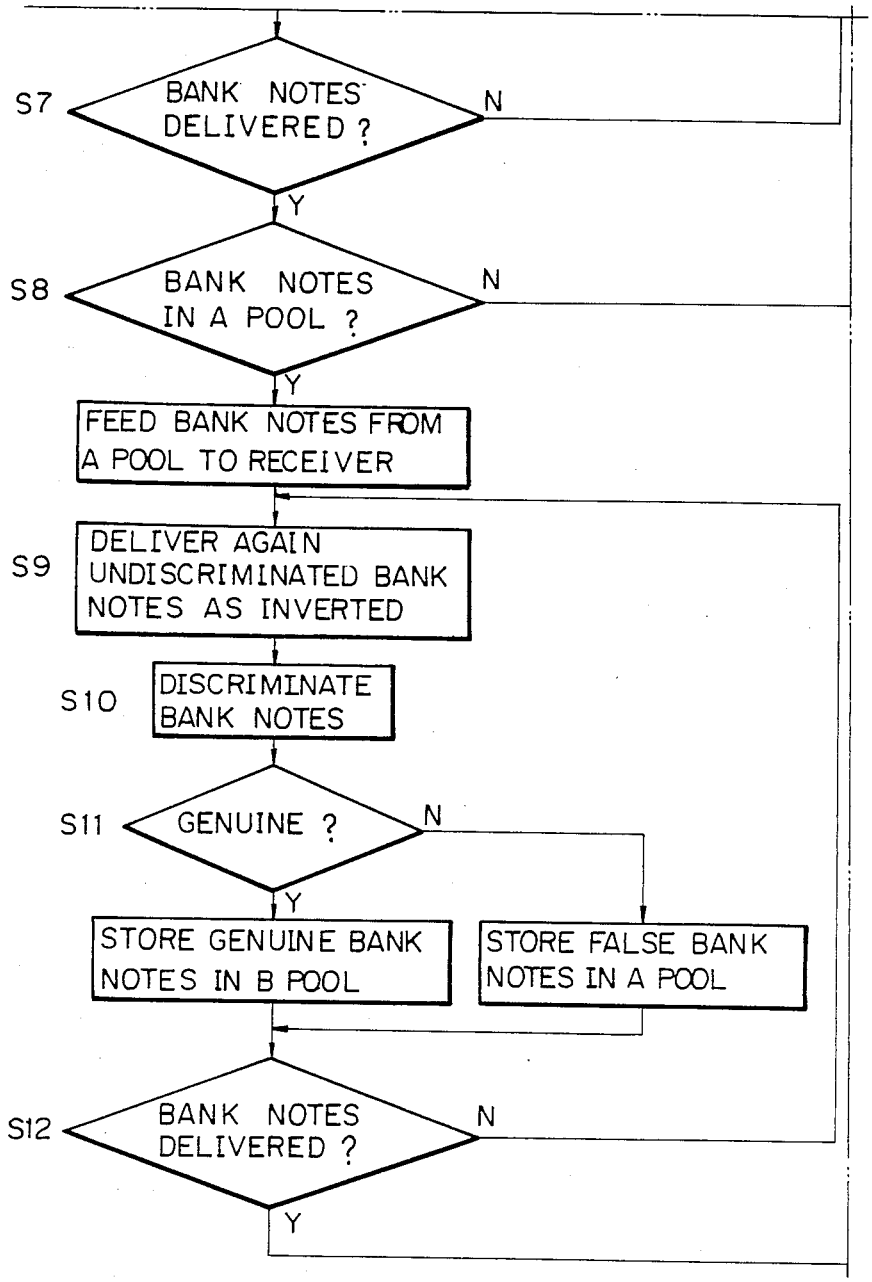
Figure 11C:
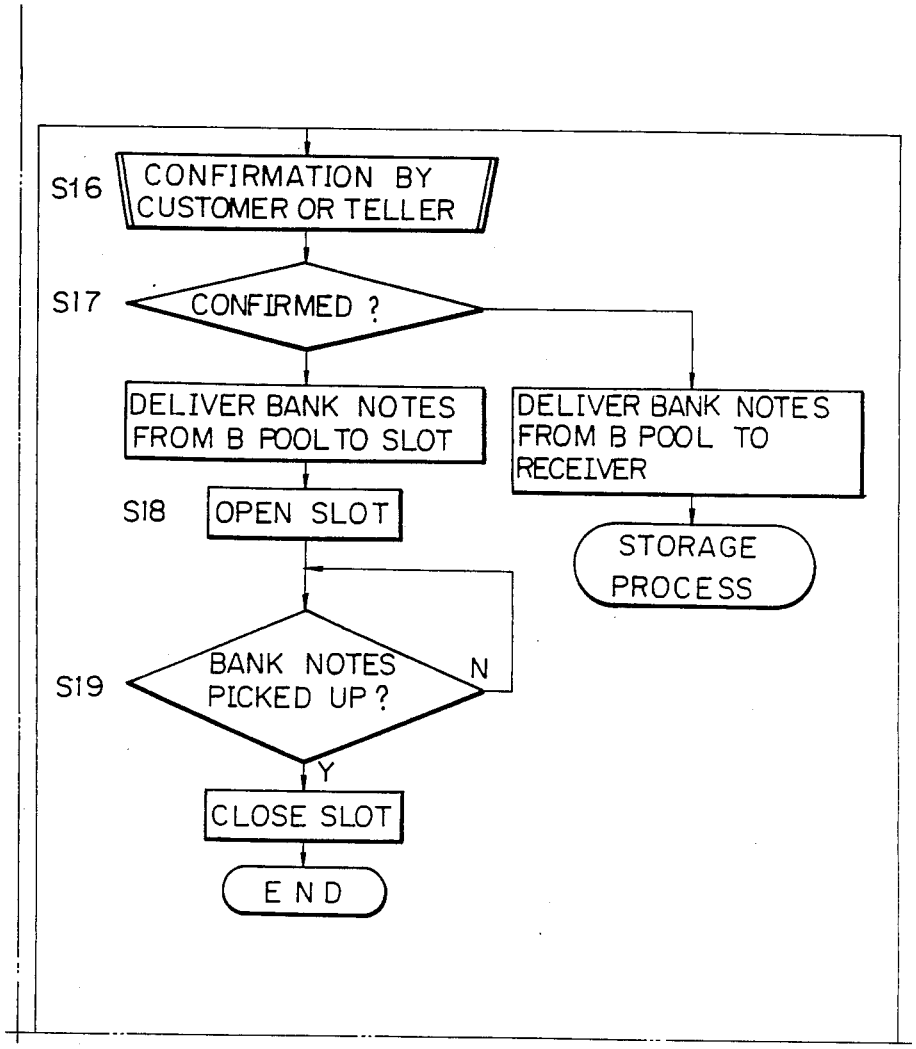
Figure 11D:
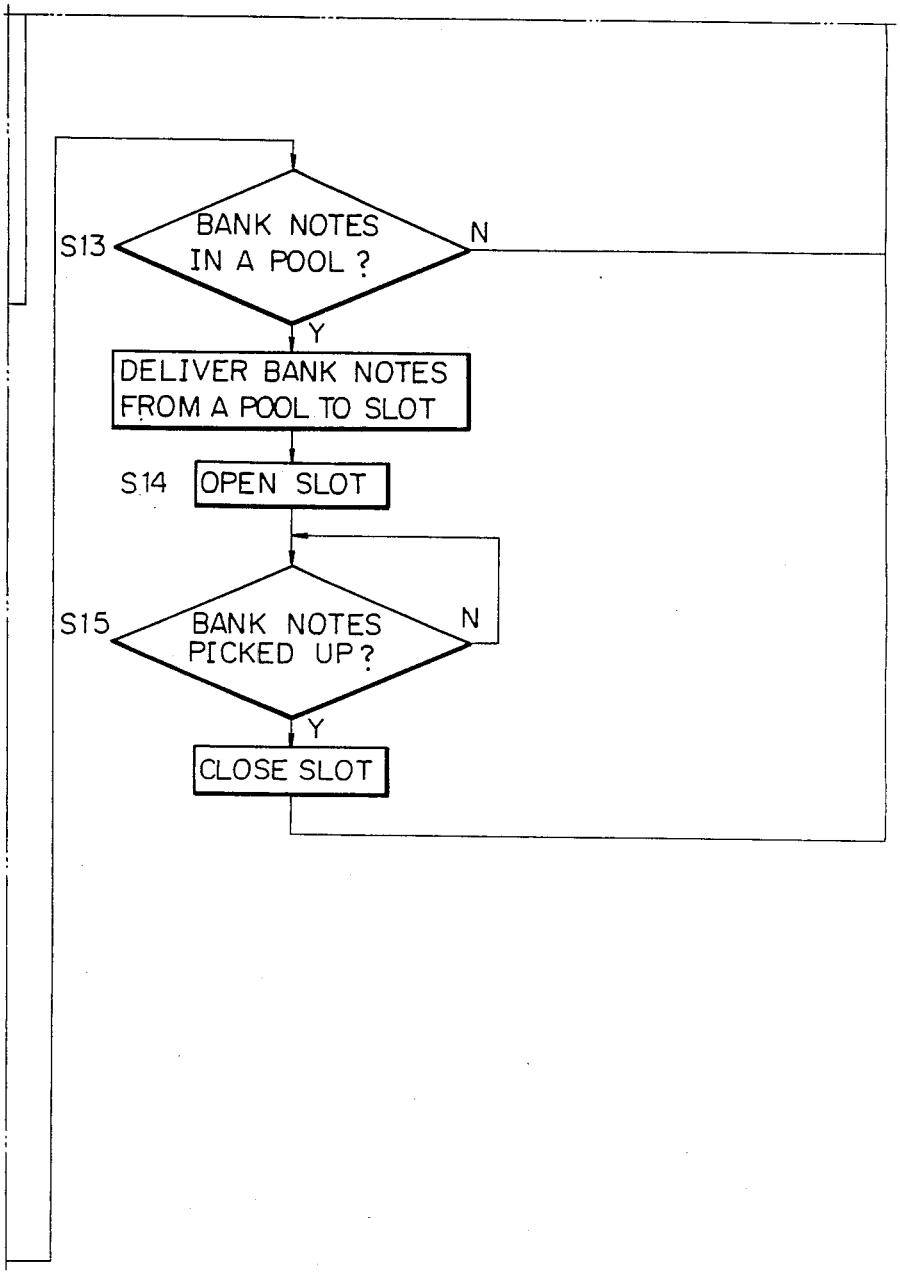
Figure 12A:
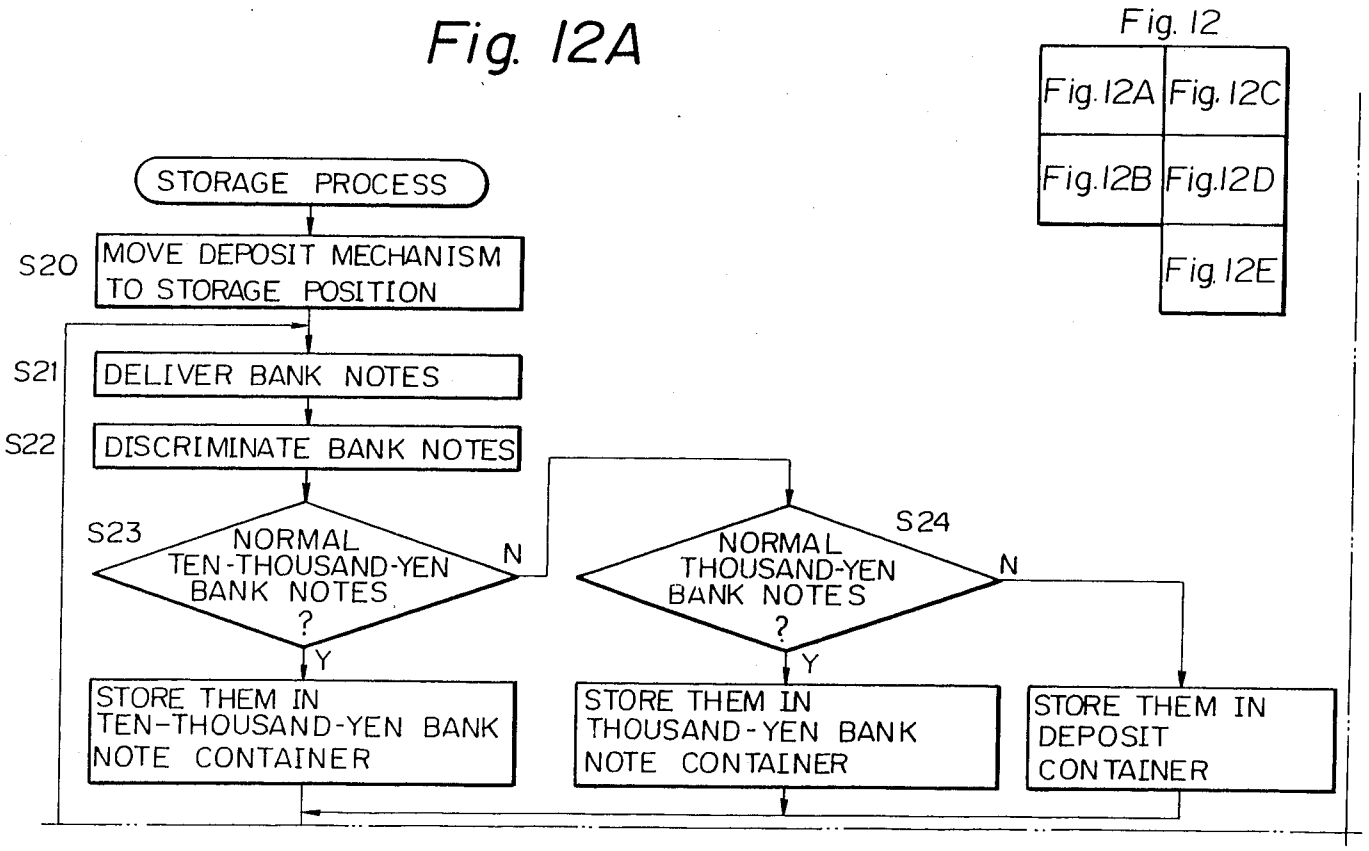
Figure 12B:
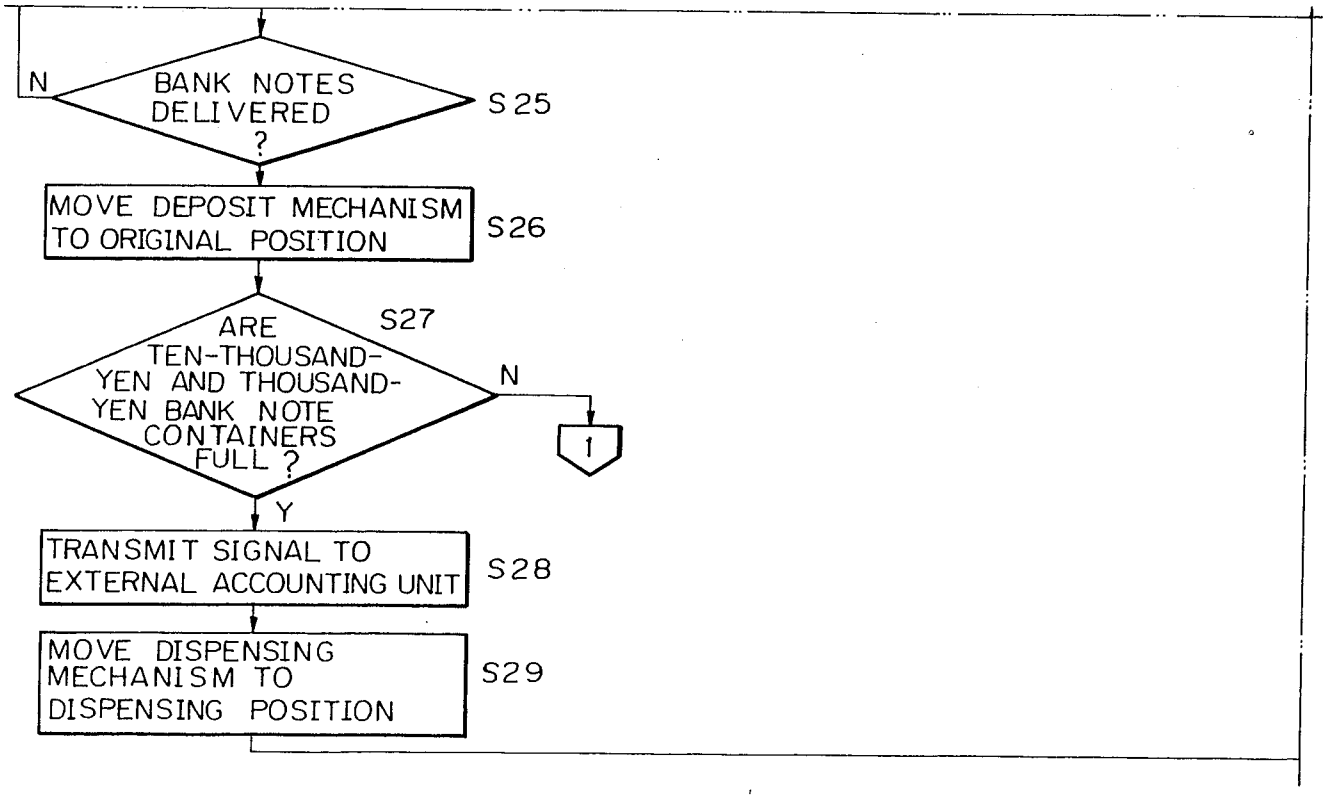
Figure 12C:
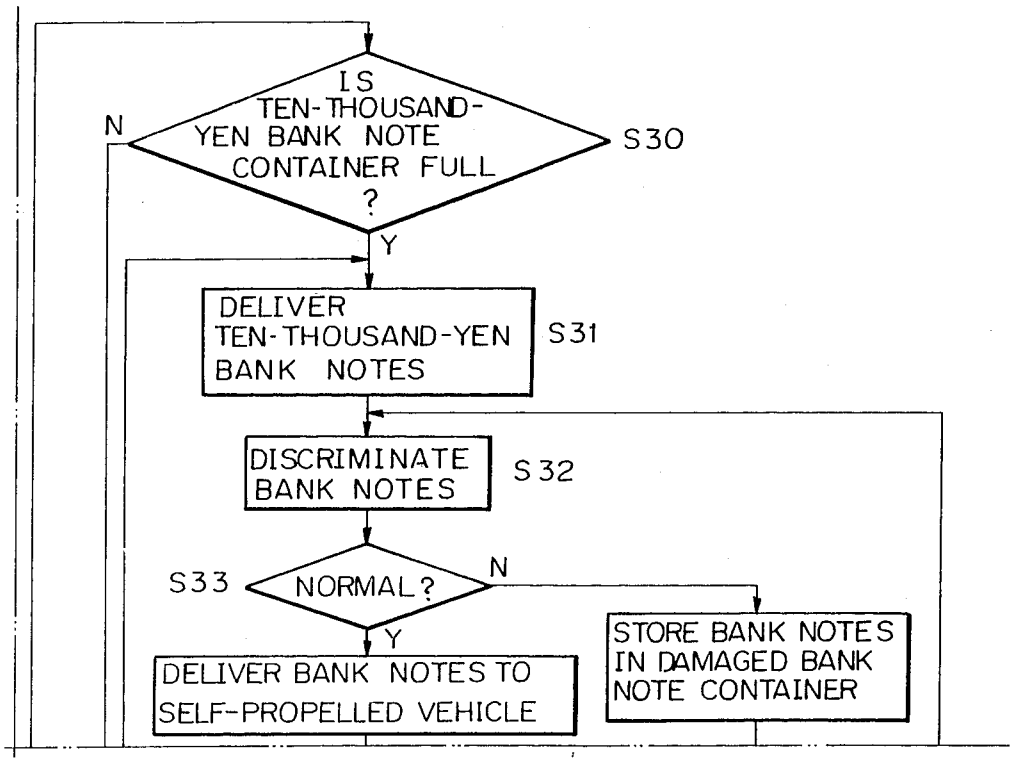
Figure 12D:
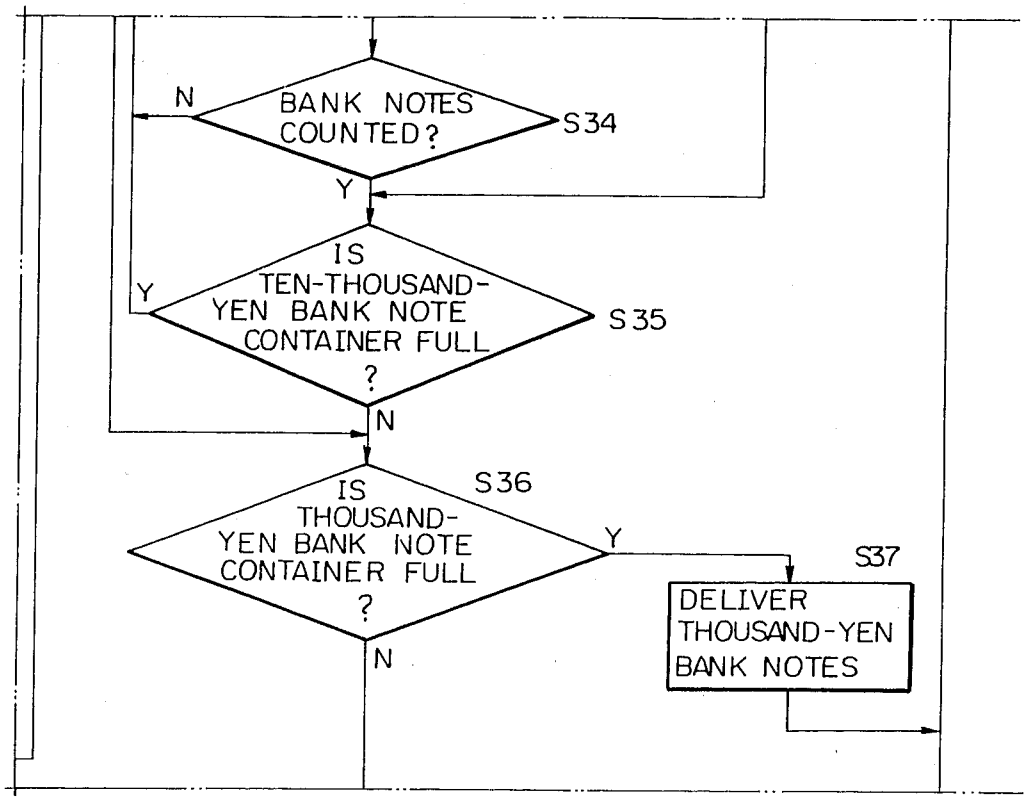
Figure 12E:
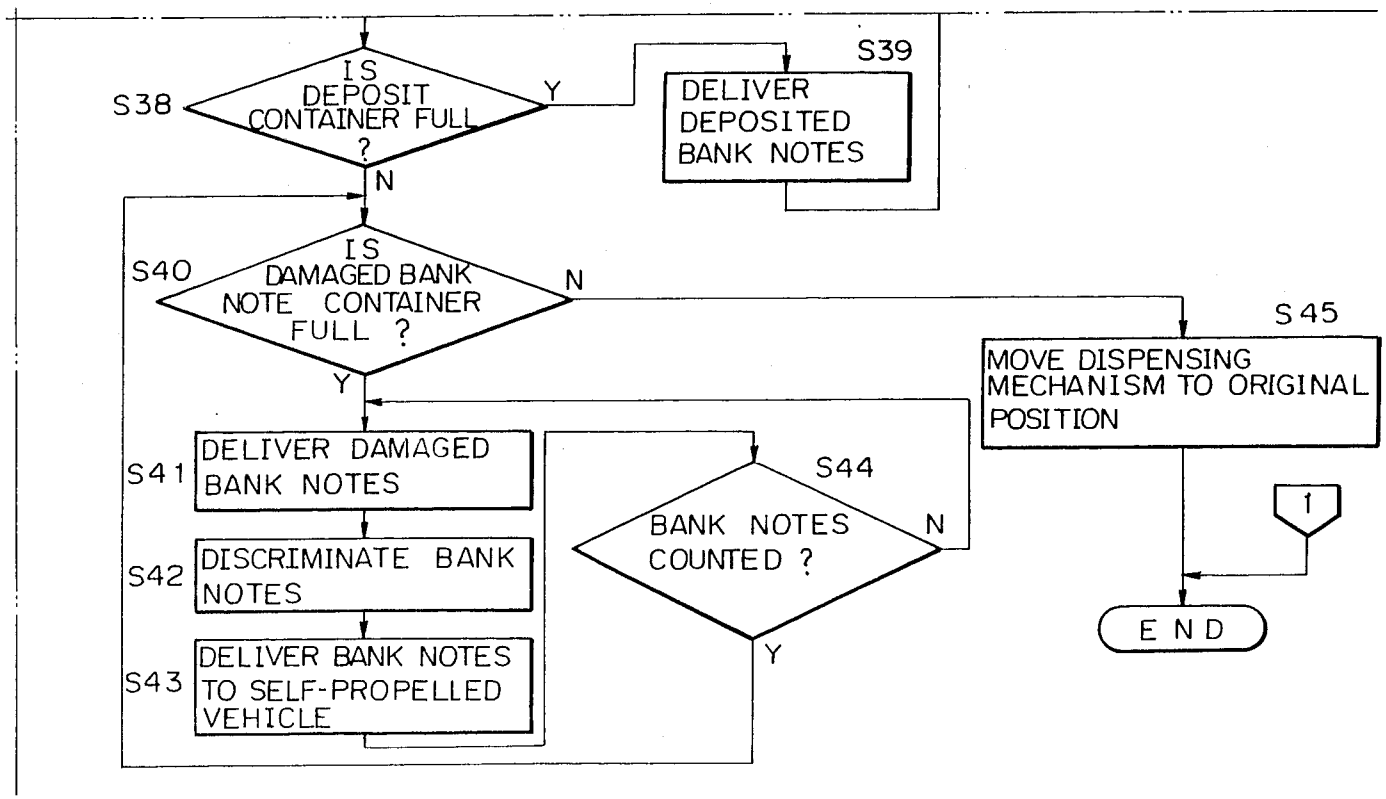
Figure 13A:
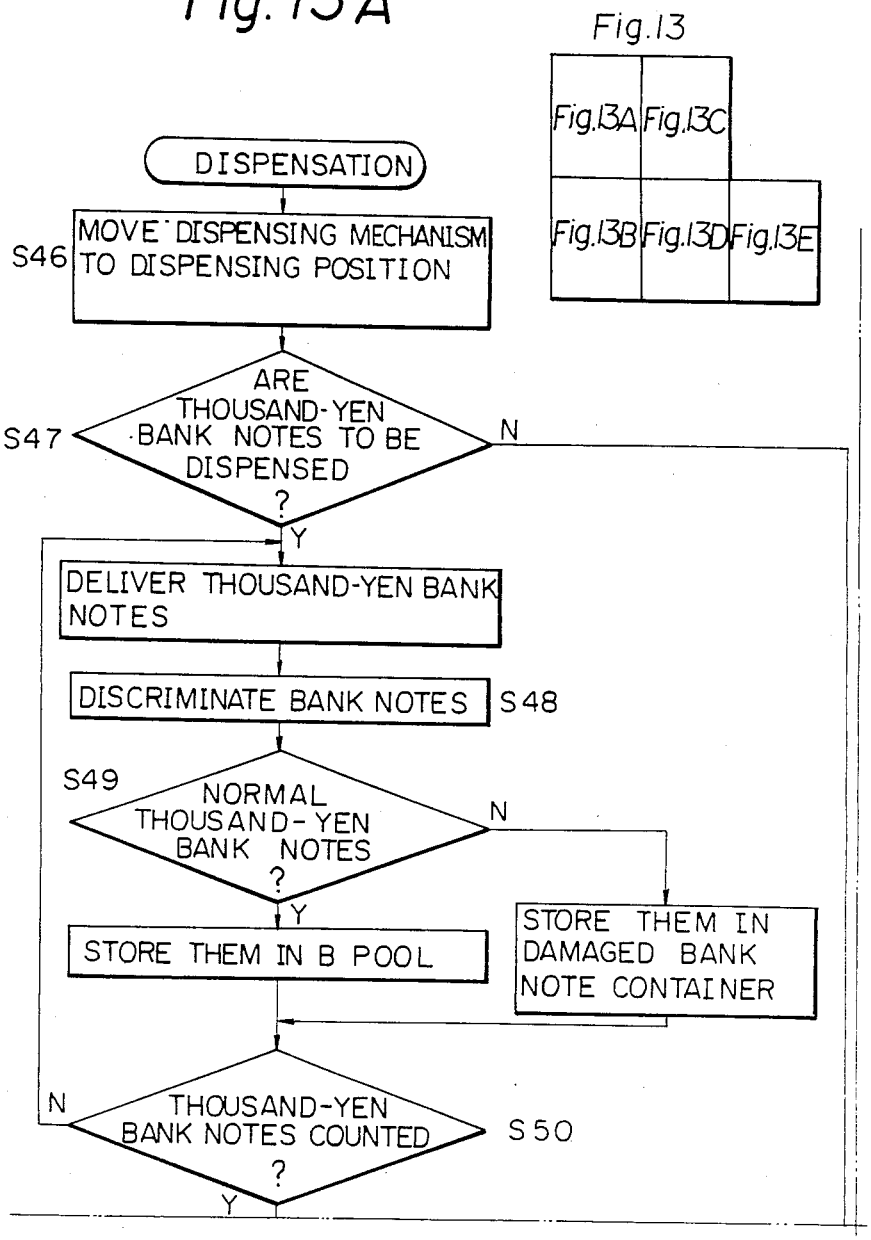
Figure 13B:
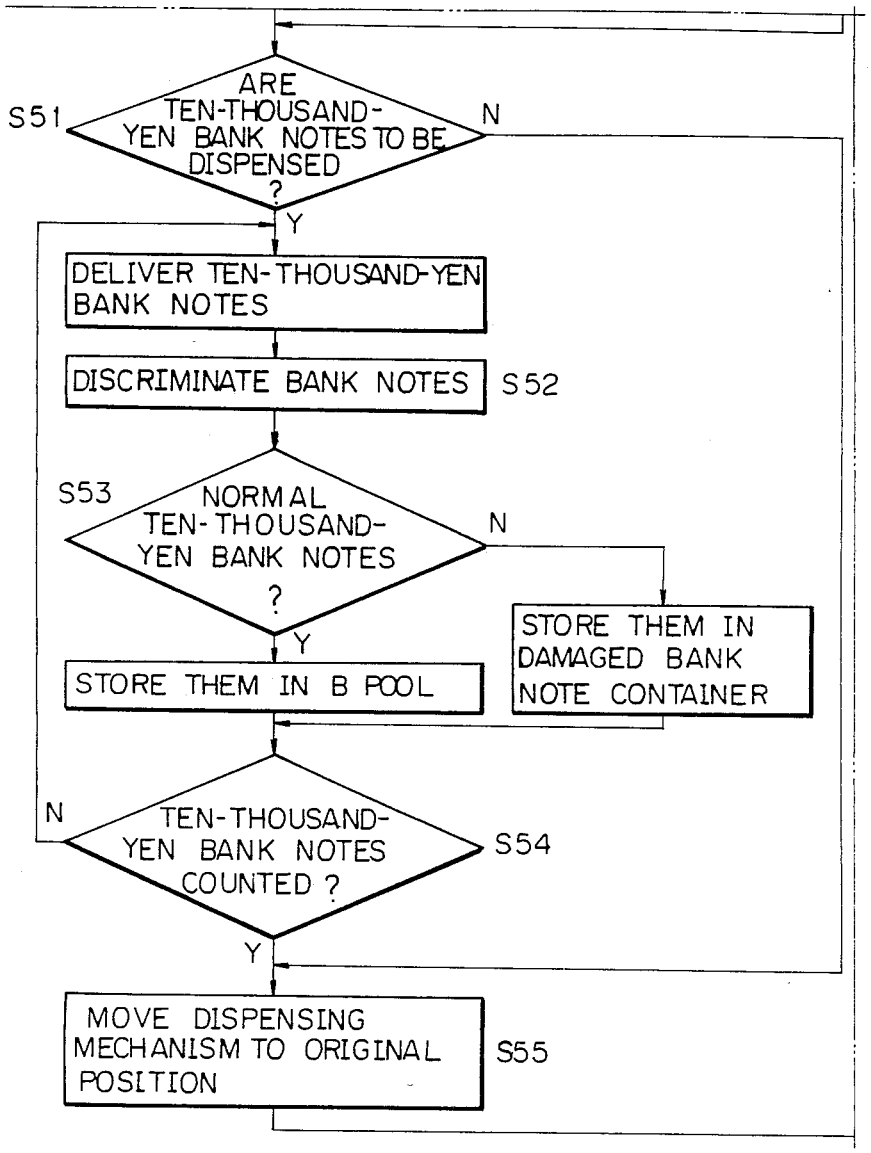
Figure 13C:
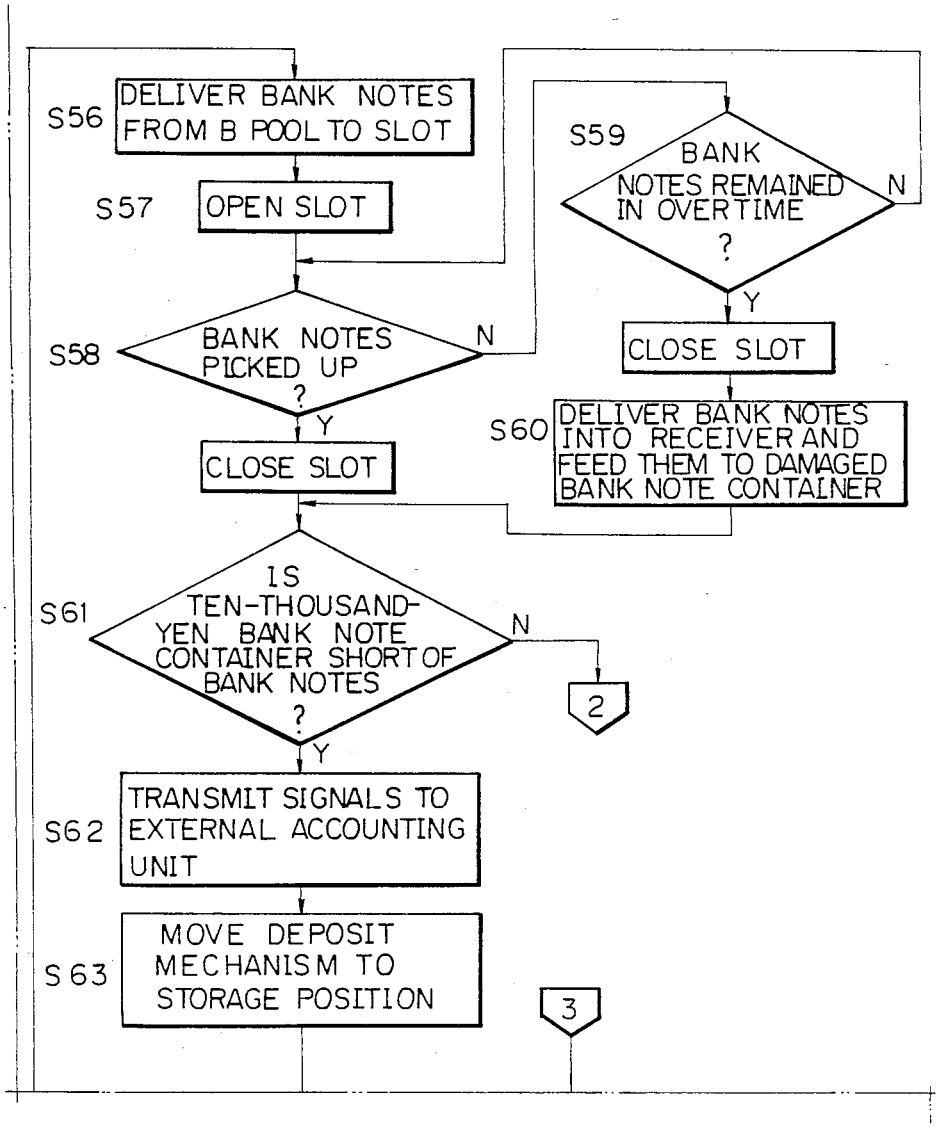
Figure 13D:
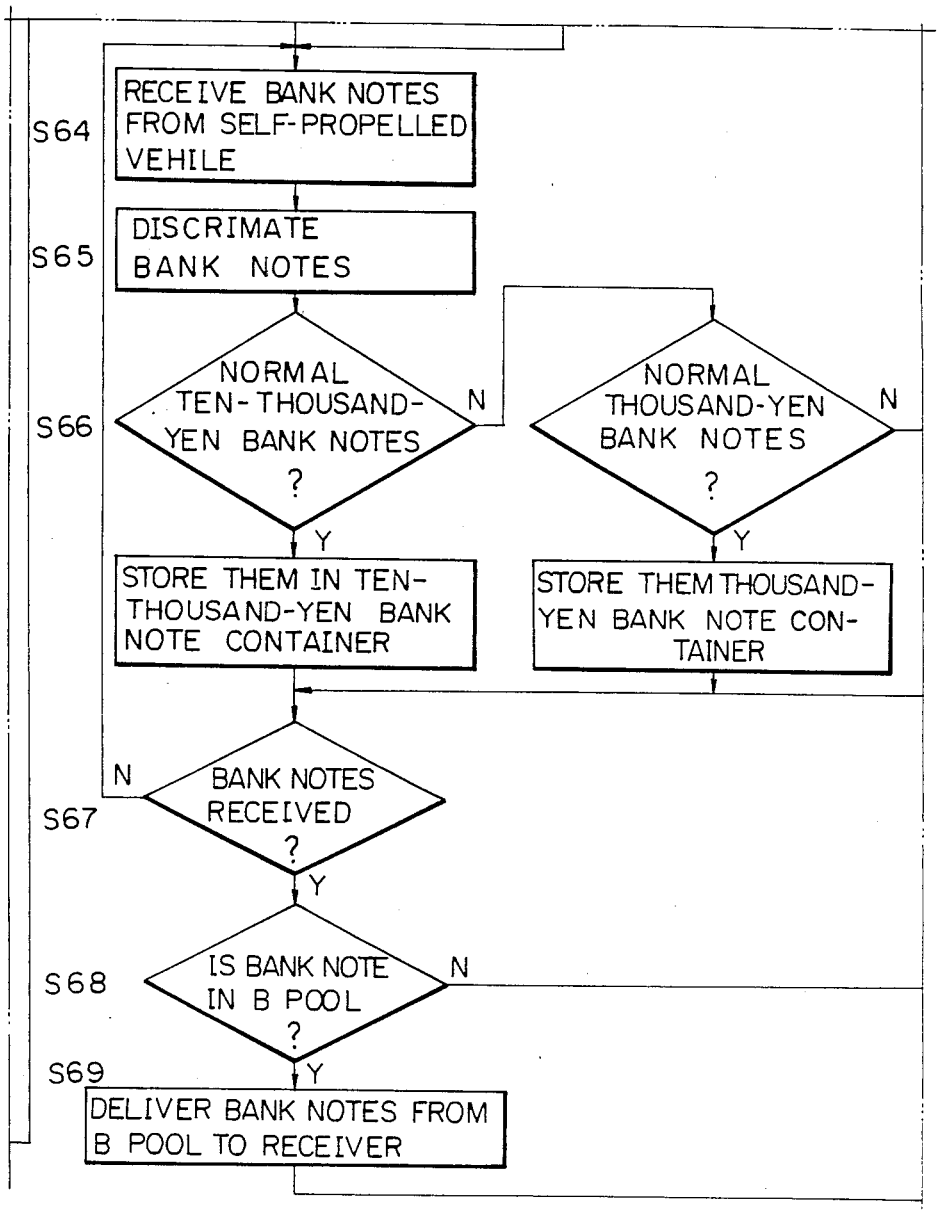
Figure 13E:
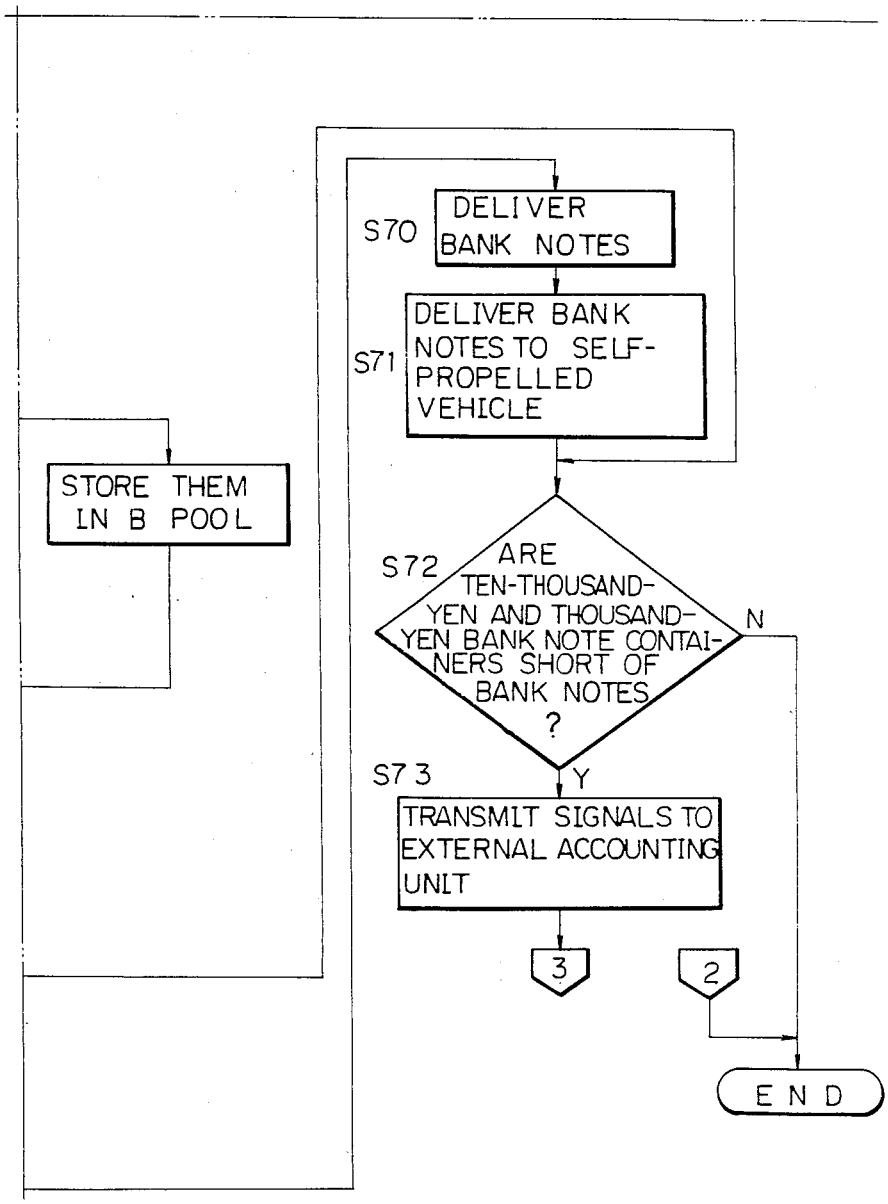

Operation of the system shown in FIGS. 9 and 10 will be described with reference to the flowcharts of FIGS. 11 through 13. Since the flowcharts shown in FIGS. 1 through 13 are similar to those illustrated in FIGS. 6 through 8, only different steps will be described hereinbelow.

(DEPOSIT)

The depositing steps S1 through S19 are identical to the steps S1 through S19 shown in FIG. 6.

(STORAGE)

Step S28:

In the step S28, when signals for collecting ten-thousand-yen bank notes, thousand-yen bank notes, and deposited bank notes are issued to the external accounting units 7, the self-propelled vehicles 6*a* is moved toward the bank note depositing and dispensing machine 5*a*, whereupon the transfer slot 46, the signal transmitter and receiver 52, and the power supply unit 53 in the machine 5*a* are coupled respectively to the transfer slot 47, the signal transmitter and receiver 54, and the power supply unit 55 in the self-propelled vehicle 6*a*, the shutters 49 in the bank note depositing and delivering machine 5*a* and the shutter for the transfer slot 47 in the self-propelled vehicle 6*a* are opened.

Step S30:

If the ten-thousand-yen bank note container 26 is full, then control goes to a step S36.

Step S33:

If the bank notes are found to be normal, then they are delivered through the feederes 14, 19, 51, 50 and the transfer slot 46 into the self-propelled vehicle 6*a*. If the bank notes are found to be damaged, the they are stored in the damaged bank note container 22.

Step S34:

If the bank notes delivered to the self-propelled vehicle 6*a* have been counted up to a prescribed number, then control goes to a step S35, and if not, then control goes back to the step S31.

Step S35:

If the ten-thousand-yen bank note container 26 is full of bank notes, then control returns to the step S31, and if not, then control goes to the step S36.

Step S36:

If the thousand-yen bank note container 24 is full of bank notes, then control goes to a step S37, and if not, then control goes to a step S38.

Step S37:

The thousand-yen bank notes are separated and delivered one by one from the thousand-yen bank note container 24.

Step S38:

If the deposit container 28 is full of bank notes, then control goes to a step S39, and if not, then control goes to a step S40.

Step S39:

The deposited bank notes are separated and delivered one by one from the deposit container 28.

Step S40:

If the damaged bank note container 22 is full of bank notes, then the storage wheel 23 and the stage 44 are moved to the dispensing positions and control goes to a step S41, and if not, then control goes to a step S45.

Step S41:

The damaged bank notes are separated and delivered one by one from the damaged bank note container 22.

Step S42:

The discriminator 13 checks the bank notes for damage.

Step S43:

The bank notes are delivered through the feeders 14, 19, 51, 50 and the transfer slot 46 into the self-propelled vehicle 6*a*.

Step S44:

If the bank notes delivered into the self-propelled vehicle 6*a* are counted up to a prescribed number, then control goes back to the step S40, and if not, control returns to the step S41.

Step S45:

The stages 44, 41, 42, 43 are moved back to their original positions, and the self-propelled vehicle 6*a* is disconnected from the bank note depositing and dispensing machine 5*a*, whereupon the storage process is finished.

(DISPENSATION)

Steps S46 through S61:

Identical to the steps S48 through S63, respectively, in FIG. 8.

Step S62:

When the controller issues signals indicating the required denominations and the number of required bank notes to the external accounting unit 7, the self-propelled vehicle 6*a* is moved to the bank note depositing and dispensing machine 5*a*, and the transfer slot 46, the signal transmitter and receiver 52, and the power supply unit 53 in the machine 5*a* are connected respectively to the transfer slot 46, the signal transmitter and receiver 54, and the power supply unit 55 in the self-propelled vehicle 6*a*. The shutters 49 and the shutter for the transfer slot 46 in the self-propelled vehicle 6*a* are opened.

Step S63:

Identical to the step S65 in FIG. 8.

Step S64:

Bank notes are delivered from the transfer slot 47 in the self-propelled vehicle 6*a* through the transfer slot 49 and the feeders 50, 12.

Steps S65 and S66:

Identical to the steps S69 and S70 in FIG. 8.

Step S67:

If the bank notes received from the self-propelled vehicle 6*a* have been completely counted up to a prescribed number, then control goes to a step S68, and if not, then control goes back to the step S64.

Step S68:

The B pool 15 is checked for any bank note therein. If there is any bank note therein, then control goes to a step S69, and if not, then control goes to a step S72.

Step S69:

The bank notes are delivered through the feeder 20 and the slot 8 into the receiver 10.

Step S70:

The bank notes are delivered one by one from the receiver 10.

Step S71:

The bank notes are delivered from the feeder 12 through the feeder 50 and the transfer slot 46 to the self-propelled vehicle 6*a*.

Step S72:

The detectors d and b check if the ten-thousand-yen bank note container 26 and the thousand-yen bank note container 24 are running short of bank notes. If so, then control goes to a step S73, and if not, then self-propelled vehicle 6*a* is disconnected from the bank note depositing and dispensing machine 5*a*, thus completing the dispensing process.

Step S73:

The controller issues signals representative of the required denominations and the number of required bank notes to the external accounting unit 7 and the self-propelled vehicle 6*a*, and control goes back to the step S64.

With the arrangement of the present invention, as described above, a means is provided for automatically supplying bank notes to and collecting bank notes from a bank note depositing and dispensing machine at a teller's cage dependent on the remaining numbers of bank notes in the bank note depositing and dispensing machine. Therefore, it is not necessary to manually load bank notes into bank note containers in the bank note depositing and dispensing machine, but it is possible to control cash or bank notes from the accounting unit and also from the self-propelled vehicle. Since the teller is not required to manually transfer cash, he or she is subject to less physical and psychological burdens, resulting in accurate and efficient banking activities. The system of the invention is a labor savor and capable of using funds efficiently. The present invention is applicable to automatic bank note depositing machines and automatic bank note dispensing machines.

Although certain preferred embodiments have been shown and described, it should be understood that many changes and modifications may be made therein without departing from the scope of the appended claims.

What is claimed is:

1. An automatic bank note depositing and dispensing machine, comprising:

a housing;

a plurality of bank note containers disposed in said housing and respectively containing bank notes of designated denominations, a prescribed number of bank notes which were previously set therein;

first detector means for detecting when the number of bank notes contained in each of said bank note containers becomes less than a first designated number;

second detector means for detecting when the number of bank notes contained in each of said bank note containers becomes more than a second designated number;

a slot formed in a rotary drum for receiving bank notes thrown in collectively;

a receiver for feeding bank notes from said slot and conveying them in succession;

a discriminator for judging whether the bank notes conveyed in succession by said receiver are geniune or false;

a first pool for pooling bank notes discriminated as being genuine by said discriminator and a second pool for pooling bank notes discriminated as being false;

a first conveyor means for connecting said first and second pools with said slot for returning the bank notes discriminated as being false from said second pool to said slot and for returning the bank notes discriminated as being genuine from said first pool to said receiver via said slot;

wherein said discriminator then judges the denomination of the genuine bank notes previously pooled in said first pool and thereafter conveyed in succession by said receiver;

a sorting means for sorting said bank notes discriminated by said discriminator for denomination into said respective designated denomination bank note containers;

a second conveyor means for taking out the bank notes contained in said plurality of the bank note containers and conveying them to said discriminator;

a bank note conveyor device provided outside of said housing for conveying bank notes from an external device to said housing in response to an output signal from said first detector means and for sending bank notes from said housing to said external device in response to an output signal from said second detector means;

a delivery part provided in said housing for receiving bank notes conveyed in response to the output signal from said first detector means and for collectively sending bank notes to said bank note conveyor device in response to the output signal from said second detector means; and a third conveyor means for collectively conveying the bank notes received at said delivery part to said slot via said first conveyor means in response to said output signal from said first detector means and for sending the bank notes received from said discriminator to the delivery part in response to said output signal from said second detector means.

2. An automatic bank note depositing and dispensing machine according to claim 1, wherein the number of bank note containers and first and second detector means are all respectively equal to a prescribed number of bank note denominations.

3. An automatic bank note depositing and dispensing machine according to claim 1, wherein said bank note conveyor device has a self-propelled vehicle which is selectively connectable to said housing.

4. An automatic bank note depositing and dispensing machine, comprising:

a housing;

a plurality of bank note containers disposed in said housing and respectively containing bank notes of designated denominations, a prescribed number of bank notes which were previously set therein;

first detector means for detecting when the number of bank notes contained in each of said bank note containers becomes less than a first designated number;

second detector means for detecting when the number of bank notes contained in each of said bank containers becomes more than a second designated number;

a slot formed in a rotary drum for receiving bank notes thrown in collectively;

a receiver for feeding bank notes from said slot and conveying them in succession;

a discriminator for judging whether the bank notes conveyed in succession by said receiver are genuine or false;

a first pool for pooling bank notes discriminated as being genuine by said discriminator and a second pool for pooling bank notes discriminated as being false;

a first conveyor means for connecting said first and second pools with said slot for returning the bank notes discriminated as being false from said second pool to said slot and for returning the bank notes discriminated as being genuine from said first pool again to said receiver via said slot;

wherein said discriminator then judges the denomination of the genuine bank notes previously pooled in said first pool and thereafter conveyed in succession by said receiver;

a sorting means for sorting said bank notes discriminated by said discriminator for denomination into said respective designated denomination bank note containers;

a second conveyor means for taking out the bank notes contained in said plurality of the bank note containers and conveying them to said discriminator;

a bank note conveyor device provided outside of said housing for conveying bank notes from an external device to said housing in response to an output signal from said first detector means and for sending bank notes from said housing to the external device in response to an output signal from said second detector means;

a delivery part provided in said housing for receiving bank notes conveyed in response to the output signal from said first detector means and for sending in succession the bank notes to said bank note conveyor device in response to the output signal from said second detector means; and a third conveyor means for conveying in succession the bank notes received at said delivery part to said discriminator in response to said output signal from said first detector means, and for sending in succession the bank notes received from said discriminator to said delivery part in response to said output signal from said second detector means.

5. An automatic bank note depositing and dispensing machine according to claim 4, wherein the number of bank note containers and first and second detector means are all respectively equal to a prescribed number of bank note denominations.

6. An automatic bank note depositing and dispensing machine according to claim 4, wherein said bank note conveyor device has a self-propelled vehicle which is selectively connectable to said housing.

* * * * *